US010738522B2

(12) United States Patent
Park et al.

(10) Patent No.: US 10,738,522 B2
(45) Date of Patent: Aug. 11, 2020

(54) COOKING APPARATUS INCLUDING TWO-WAY OPENABLE DOOR

(71) Applicant: LG Electronics Inc., Seoul (KR)

(72) Inventors: Kyoung-Joon Park, Seoul (KR); Hoon Seob Sim, Seoul (KR); Jaekyung Yang, Seoul (KR); Suyoung Lee, Seoul (KR); Yongsoo Lee, Seoul (KR); Yong Hyun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 81 days.

(21) Appl. No.: 16/056,664

(22) Filed: Aug. 7, 2018

(65) Prior Publication Data

US 2019/0040666 A1 Feb. 7, 2019

(30) Foreign Application Priority Data

Aug. 7, 2017 (KR) ..... 10-2017-0099855

(51) Int. Cl.
*A47B 81/00* (2006.01)
*E05D 15/52* (2006.01)
*F24C 15/02* (2006.01)

(52) U.S. Cl.
CPC ..... *E05D 15/52* (2013.01); *F24C 15/023* (2013.01); *F24C 15/024* (2013.01); *F24C 15/026* (2013.01); *F24C 15/028* (2013.01); *E05Y 2900/308* (2013.01)

(58) Field of Classification Search
CPC ..... E05D 15/52; E05D 15/522; E05D 15/523; E05D 15/524
See application file for complete search history.

(56) References Cited

U.S. PATENT DOCUMENTS 3,018,508 A * 1/1962 Keeling, Sr. ..... E05D 15/52 16/232
3,030,656 A 4/1962 Hopkins
3,802,124 A * 4/1974 Guerrini ..... E05D 15/526 49/192
4,035,953 A * 7/1977 Bierlich ..... E05D 15/5211 49/192

(Continued)

FOREIGN PATENT DOCUMENTS

DE 39 22 839 A1 1/1991
FR 1 081 674 A 12/1954

OTHER PUBLICATIONS

European Search Report in European Application No. 18187439.7, dated Dec. 3, 2018, 10 pages.

*Primary Examiner* — Matthew W Ing
(74) *Attorney, Agent, or Firm* — Fish & Richardson, P.C.

(57) ABSTRACT

A door includes a handle, a handle link configured to rotate about a handle shaft, a first swing hinge shaft configured to protrude outward from and retract into a first side of the door, a pull-down configured to protrude outward from and retract into a second side of the door, a first main link having a first end rotatably connected to the handle link and a second end rotatably connected to the first swing hinge shaft, and a second main link having a first end rotatably connected to the handle link and a second end rotatably connected to the pull-down bar. The pull-down bar and the first swing hinge shaft are each configured to protrude from or retract to a side of the door based on rotation of the handle.

19 Claims, 16 Drawing Sheets

(56) References Cited

U.S. PATENT DOCUMENTS

| | | | | |
|---|---|---|---|---|
| 4,532,673 | A * | 8/1985 | Kim | E05D 15/50 16/230 |
| 6,782,661 | B2 * | 8/2004 | Manzella | E05F 11/16 49/192 |
| 9,567,701 | B2 * | 2/2017 | Lee | D06F 7/225 |
| 9,650,737 | B2 * | 5/2017 | Lee | D06F 7/28 |
| 9,695,543 | B2 * | 7/2017 | Sim | D06F 9/12 |
| 9,790,633 | B2 * | 10/2017 | Lee | D06F 7/28 |
| 9,890,495 | B2 * | 2/2018 | Lee | D06F 9/14 |
| 2019/0301747 | A1 * | 10/2019 | Yang | F24C 15/023 |

* cited by examiner

COOKING APPARATUS INCLUDING TWO-WAY OPENABLE DOOR

CROSS-REFERENCE TO RELATED APPLICATION

This application claims priority to and the benefit of Korean Patent Application No. 10-2017-0099855, filed on Aug. 7, 2017, the disclosure of which is incorporated herein by reference in its entirety.

FIELD

The present invention relates to a cooking apparatus including a door, and more particularly, to a cooking apparatus having a structure capable of opening a door using a pull-down method around a horizontal shaft or using a side-swing method around a vertical shaft.

BACKGROUND

An oven is a cooking apparatus which cooks food by heating a cooking chamber therein. A cooking apparatus like an oven includes a body including a cavity open frontward and a door that opens and closes an open front surface of the body.

In the case of an oven, a structure in which a door swings sideward around a rotating shaft vertically provided on a left or right side of a body is used or a structure in which a door opens downward around a rotating shaft horizontally provided at a bottom of the body is used.

In the case of an oven having a structure in which a door is pulled down, that is, opens downward, since the door extends forward while being opened, it is difficult for a user to reach into the oven. Generally, when a door is horizontally disposed and opened frontward, it is convenient for putting items necessary for cooking, on an inside of the door.

In the case of an oven having a structure in which a door swings sideward, that is, is opened sideward, it is easy to reach an internal space of the oven while the door is opened. Also, when an oven is a built-in type, the oven is installable without leftward and rightward spaces. However, unlike the structure in which the door is opened downward, there is no additional space for temporarily putting food thereon in the structure in which the door is opened sideward.

In consideration of this point, a cooking apparatus in which a door is openable through swinging or being pulled down has been developed. This uses a spring and cam structure, a rack and pinion structure, or the like. These types of two-way openable door structure have inconvenient elements such as requiring considerable force from a user to convert a direction of opening the door.

In the case of the spring and cam structure, since a hinge shaft, which supports pivoting of a door, is supported by an elastic force, the spring and cam structure is insufficient to provide reliability and stability in use.

In the case of the rack and pinion structure, since motions of a rack and a pinion always interwork with each other, it is not possible to intentionally cause a delay between an operation of a user to select an opening direction of the door and an actual movement operation of each component.

SUMMARY

It is an aspect of the present invention to provide a door having a two-way openable door structure capable of providing adequate reliability and stability with respect to a two-way opening operation and causing an intentional delay between an operation of a user and an operation of each component, and a cooking apparatus including the same.

It is another aspect of the present invention to provide a door with a simple structure capable of selecting an opening direction of the door, and a cooking apparatus including the same.

It is another aspect of the present invention to provide a double-hinge operation structure having a high degree of freedom in design between an operation range of a user selecting an opening direction of a door and an actual opening direction conversion operation.

According to one aspect of the subject matter described in this application, a door includes a double hinge operation structure that is configured to couple to a body and that is configured to rotate relative to the door. The door further includes a handle located at a first corner of the door and configured to rotate about a handle shaft, a handle link configured to rotate about the handle shaft based on rotation of the handle, a first swing hinge shaft that is located at a second corner of the door and configured to protrude outward from and retract into a first side of the door that extends from the first corner to the second corner, a pull-down bar that is located at a third corner of the door and that is configured to protrude outward from and retract into a second side of the door that extends between the second corner and the third corner, where the third corner is located at a diagonal position of the second corner. The door further includes (i) a first main link having a first end rotatably connected to the handle link, a second end rotatably connected to the first swing hinge shaft, and a first rotation supporting point that is located between the first end and the second end of the first main link and that is configured to rotatably support the first main link, where the first main link is configured to rotate about the first rotation supporting point, and (ii) a second main link having a first end rotatably connected to the handle link, a second end rotatably connected to the pull-down bar, and a second rotation supporting point that is located between the first end and the second end of the second main link and that is configured to rotatably support the second main link, where the second main link is configured to rotate about the second rotation supporting point. The handle is configured to rotate about the handle shaft between a pull-down position and a side-swing position.

The pull-down bar is configured to protrude outward from the second side of the door based on the handle rotating from the side-swing position to the pull-down position, and to retract inward into the second side of the door based on the handle rotating from the pull-down position to the side-swing position. The first swing hinge shaft is configured to protrude outward from the first side of the door based on the handle rotating from the pull-down position to the side-swing position, and to retract inward into the first side of the door based on the handle rotating from the side-swing position to the pull-down position.

Implementations according to this aspect may include one of more of the following features. For example, at least one of the first main link or the handle link may define a first handle-side slit that allows the handle link to translate and rotate relative to the first main link and that is configured to receive a connection part configured to connect the handle link to the first main link. In some implementations, the door further includes a first intermediate link that is configured to rotatably connect the handle link to the first main link, the first intermediate link having a first end rotatably connected to the handle link and a second end rotatably connected to the first main link.

In some implementations, the first swing hinge shaft is configured to, based on movement with respect to the first side of the door, be exposed outside of the door or insert into an inside of the door, and at least one of the first swing hinge shaft or the first main link defines a swing hinge side slit that allows the first swing hinge shaft to translate and rotate relative to the first main link and that is configured to receive a connection part configured to connect the first swing hinge shaft to the first main link. In some examples, at least one of the handle link or the second main link may define a second handle-side slit that allows the handle link to translate and rotate relative to the second main link and that is configured to receive a connection part configured to connect the handle link to the second main link.

In some implementations, the door further includes a second intermediate link that is configured to rotatably connect the handle link to the second main link, the second intermediate link having a first end rotatably connected to the handle link and a second end rotatably connected to the second main link. In some implementations, the pull-down bar is configured to, based on movement with respect to the second side of the door, be exposed outside of the door or insert into an inside of the door, and at least one of the pull-down bar or the second main link defines a pull-down hinge side slit that allows the pull-down bar to translate and rotate relative to the second main link and that is configured to receive a connection part configured to connect the pull-down bar to the second main link.

In some implementations, the first main link extends in a first direction toward the first swing hinge shaft, and the second main link extends in a second direction toward the pull-down bar, and at least one of the first main link or the second main link includes a deflected portion that extends in a direction different from the first direction or the second direction.

In some implementations, the handle includes a grip portion that extends from the handle shaft, that is configured to be oriented to a horizontal direction of the door toward the second corner based on the handle being oriented to the pull-down position, and that is configured to be oriented to a vertical direction of the door toward the third corner based on the handle being oriented to the side-swing position.

In some implementations, the handle is further configured to rotate to a locked position between the pull-down position and the side-swing position, and the pull-down bar is configured to maintain a state of protruding outward from the second side of the door based on the handle being positioned at the locked position. In the same or other implementations, the first swing hinge shaft is configured to maintain a state of protruding outward from the first side of the door based on the handle being positioned at the locked position. In some examples, the door further includes a handle base that is coupled to the door and that is configured to support rotation of the handle shaft, where the handle base defines a plurality of holding holes arranged about a rotational center of the handle shaft in a circumferential direction of the handle shaft.

The handle may include a holding hook and a switch configured to apply elastic force to the holding hook, where the holding hook may be configured to insert into a holding hole of the plurality of holding holes based on the elastic force, and to be released from the holding hole based on the switch being pushed to overcome the elastic force applied to the holding hook. In some examples, the holding hook is further configured to, based on the handle being positioned at the pull-down position, the locked position, or the side-swing position, insert into one of the plurality of holding holes to restrict rotation of the handle.

According to another aspect, a cooking apparatus includes a body that defines a cavity having a front opening, and a door that is configured to couple to the body and configured to open and close at least a portion of the front opening. The door includes a handle located at a first corner of the door and configured to rotate about a handle shaft, a handle link configured to rotate about the handle shaft based on rotation of the handle, a first swing hinge shaft that is located at a second corner of the door and configured to protrude outward from and retract into a first side of the door that extends from the first corner to the second corner, a pull-down bar that is located at a third corner of the door and that is configured to protrude outward from and retract into a second side of the door that extends between the second corner and the third corner, where the third corner is located at a diagonal position of the second corner. The door further includes (i) a first main link having a first end rotatably connected to the handle link, a second end rotatably connected to the first swing hinge shaft, and a first rotation supporting point that is located between the first end and the second end of the first main link and that is configured to rotatably support the first main link, where the first main link is configured to rotate about the first rotation supporting point, and (ii) a second main link having a first end rotatably connected to the handle link, a second end rotatably connected to the pull-down bar, and a second rotation supporting point that is located between the first end and the second end of the second main link and that is configured to rotatably support the second main link, the second main link being configured to rotate about the second rotation supporting point.

The cooking apparatus further includes: a hinge guide that is located at the body at a position corresponding to the second corner of the door, that is configured to receive the first swing hinge shaft based on the first swing hinge shaft protruding from the first side of the door, and that is configured to be spaced apart from the first swing hinge shaft based on the first swing hinge shaft retracting into the first side of the door; a mixed hinge that is located at the body at a position corresponding to a fourth corner of the door, that is located at a diagonal position of the first corner of the door, and that extends along a protrusion-retraction direction of the first swing hinge shaft; a pull-down hinge located at the body at a position corresponding to the third corner of the door; and a second swing hinge shaft that rotatably couples the mixed hinge to the fourth corner of the door and that extends in the protrusion-retraction direction of the first swing hinge shaft. The pull-down hinge defines a pull-down bar fastening hole that is configured to receive the pull-down bar based on the pull-down bar protruding from the second side of the door and that is configured to be spaced apart from the pull-down bar based on the pull-down bar retracting into the second side of the door.

Implementations according to this aspect may include one or more of the following features. For examples, the mixed hinge includes a first pull-down body coupled to the body, and a first bracket that is coupled to the first pull-down body by a first pull-down hinge, that is coupled to the fourth corner of the door by the second swing hinge shaft, and that is configured to rotate about the first pull-down hinge based on rotation of the door. In some examples, the pull-down hinge includes a second pull-down body coupled to the body, and a second bracket that is coupled to the second pull-down body by a second pull-down hinge, that defines the pull-down bar fastening hole, and that is configured to interfere with the third corner of the door based on insertion of the pull-down bar into the pull-down bar fastening hole. The pull-down bar fastening hole may be configured to restrict rotation of the second bracket about the pull-down bar based on insertion of the pull-down bar into the pull-down bar fastening hole. The second bracket may be configured to rotate around the second pull-down hinge based on rotation of the door in a state in which the pull-down bar is inserted into the pull-down bar fastening hole.

In some implementations, the door is configured to close the front opening in an upward direction of the body, where the first pull-down body is configured to elastically move in the upward direction. In some examples, the handle is configured to rotate about the handle shaft between a pull-down position and a side-swing position, where the pull-down bar is configured to protrude outward from the second side of the door based on the handle rotating from the side-swing position to the pull-down position, and to retract inward into the second side of the door based on the handle rotating from the pull-down position to the side-swing position. The first swing hinge shaft may be configured to protrude outward from the first side of the door based on the handle rotating from the pull-down position to the side-swing position, and to retract inward into the first side of the door based on the handle rotating from the side-swing position to the pull-down position.

In some implementations, at least one of the first main link or the handle link may define a first handle-side slit that allows the handle link to translate and rotate relative to the first main link and that is configured to receive a connection part configured to connect the handle link to the first main link. In some examples, the cooking apparatus may further include a first intermediate link that is configured to rotatably connect the handle link to the first main link, the first intermediate link having a first end rotatably connected to the handle link and a second end rotatably connected to the first main link. In some examples, the first swing hinge shaft may be configured to, based on movement with respect to the first side of the door, be exposed outside of the door or insert into an inside of the door, where at least one of the first swing hinge shaft or the first main link defines a swing hinge side slit that allows the first swing hinge shaft to translate and rotate relative to the first main link and that is configured to receive a connection part configured to connect the first swing hinge shaft to the first main link.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Hereinafter, exemplary embodiments of the present disclosure will be described in detail with reference to the attached drawings.

The present invention is not limited to the following embodiments and may be provided in various different forms. However, the embodiments are provided to completely disclose the present invention and to completely convey the scope of the present invention to one of ordinary skill in the art.

[Handle of Cooking Apparatus and Opening Direction of Door]

The present invention relates to a cooking apparatus, and hereafter, an oven, which is a type of cooking apparatus, will be described as an example of the present invention.

An oven 1 includes a body 10 having a frontward-open rectangular parallelepiped shape with a hollow therein and a door 30 having a rectangular shape that opens and closes an open front surface of the body 10. The door 30 has a certain forward and rearward width or depth. The oven 1 is illustrated without an outer housing to allow an internal structure thereof to be more easily understood. The hollow of the oven 1, that is, a cavity 20, includes a shelf. Food is put on the shelf to be cooked and then is cooked by applying heat to an inside of the cavity 20 while the door 30 is closed.

Figure 5:
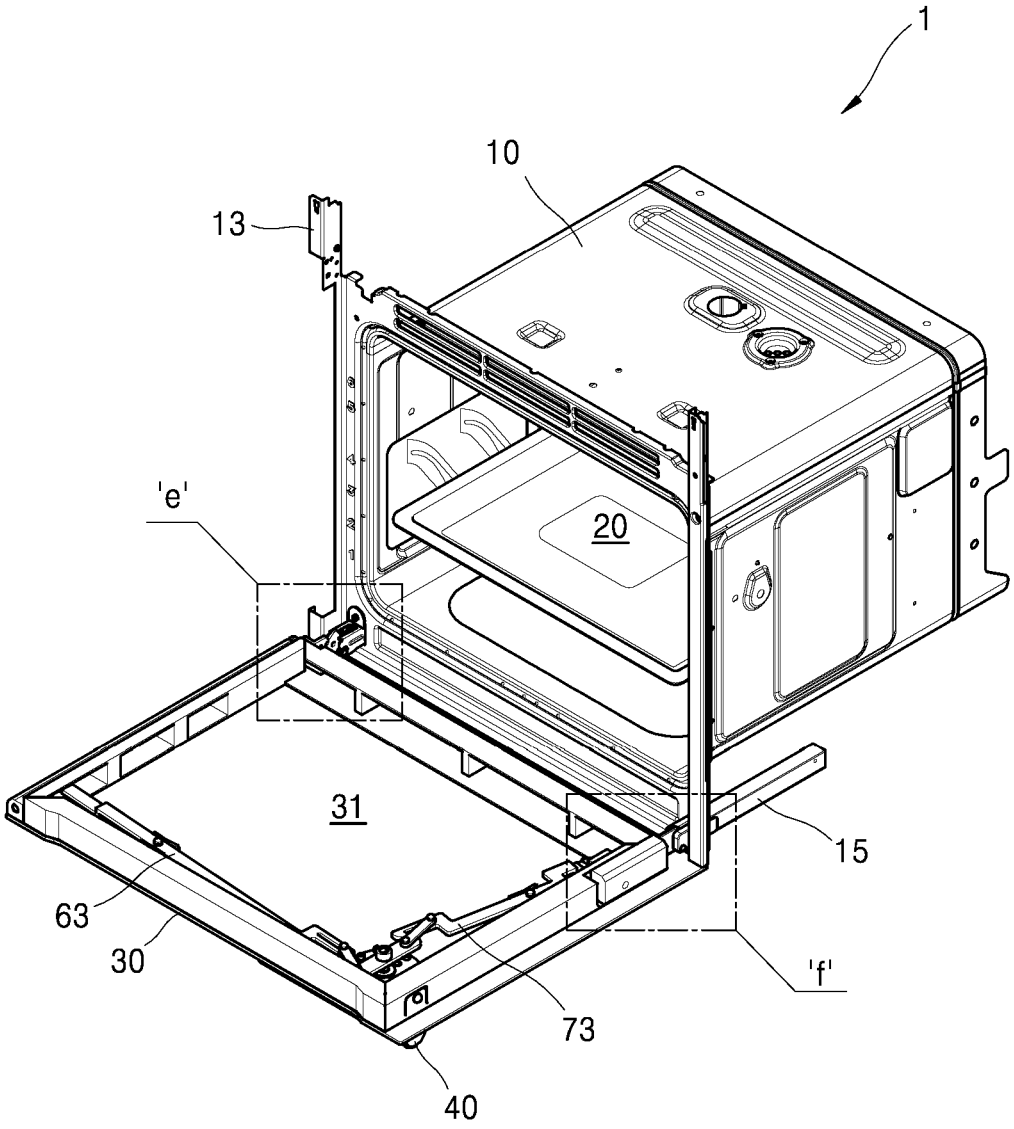
FIG. 5 is a view illustrating a state in which the door is opened in a pull-down direction from the body in the state in FIG. 3.
Figure 11:
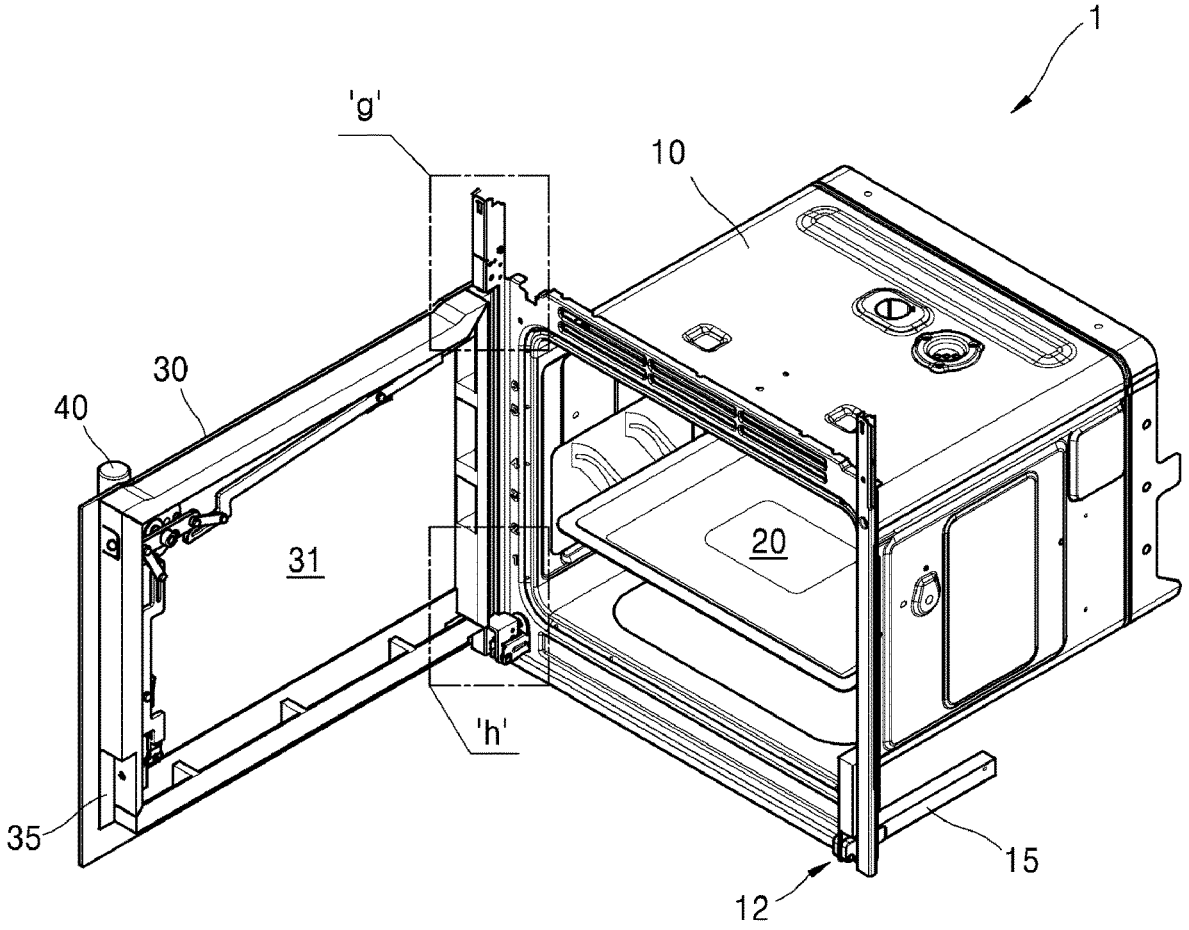
FIG. 11 is a view illustrating a state in which the door is opened in a side-swing direction from the body in the state in FIG. 10.

The door 30 provided in front of the body 10 may be opened by a pull-down method of being opened downward toward a bottom of the front, as shown in FIG. 5, or may be opened by a side-swing method of being opened toward one side, as shown in FIG. 11 (in the drawing, being opened leftward). An opening direction of the door 30 may be selected by a user.

Figure 3:
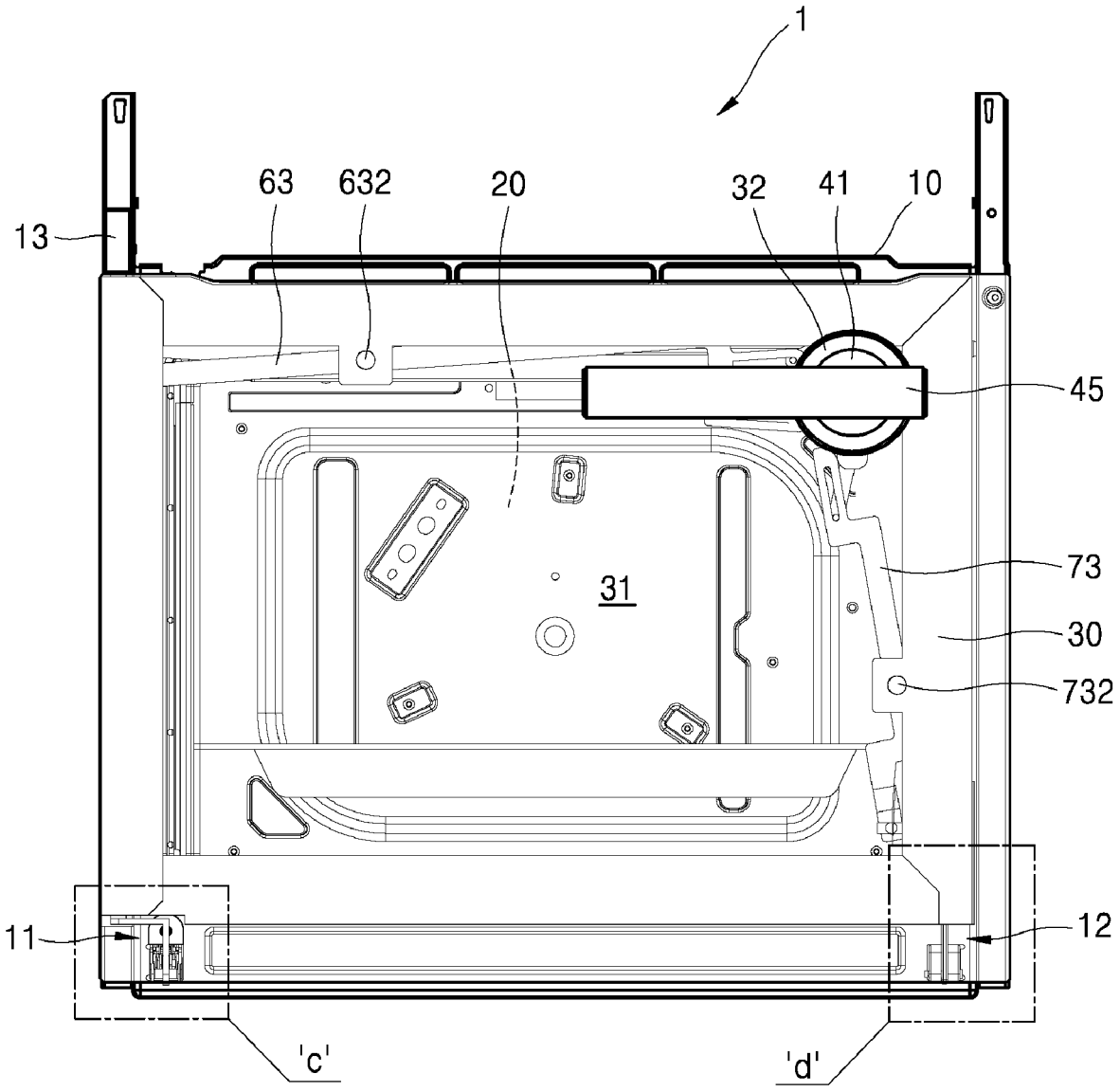
FIG. 3 is a front view illustrating a state in which the door of FIG. 1 is installed in a body and closed.
Figure 4A:
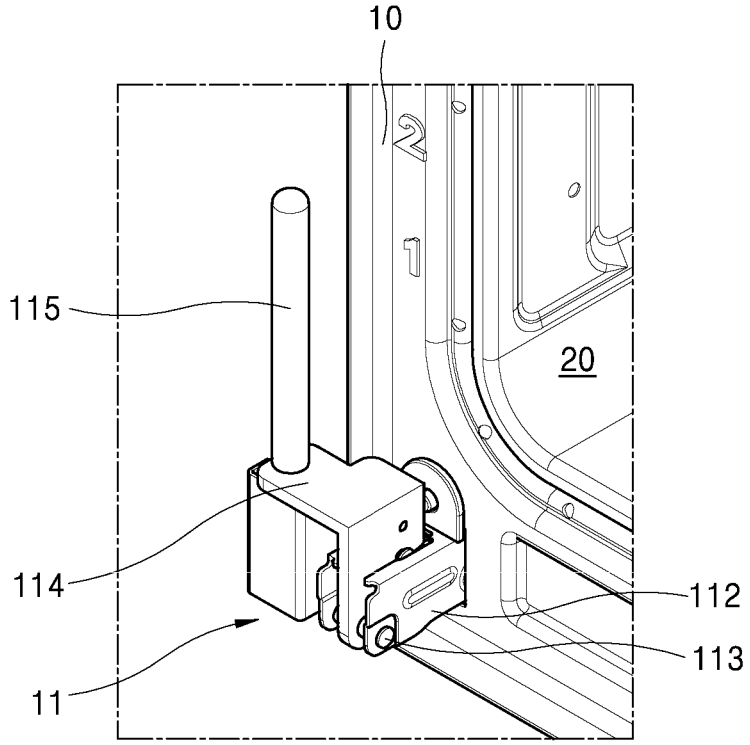
FIGS. 4A and 4B are views illustrating part 'c' and part 'd' in FIG. 3 in which the door is omitted and illustrating positions of a mixed hinge and a pull-down hinge installed at a bottom of the body while the door is closed.
Figure 4B:
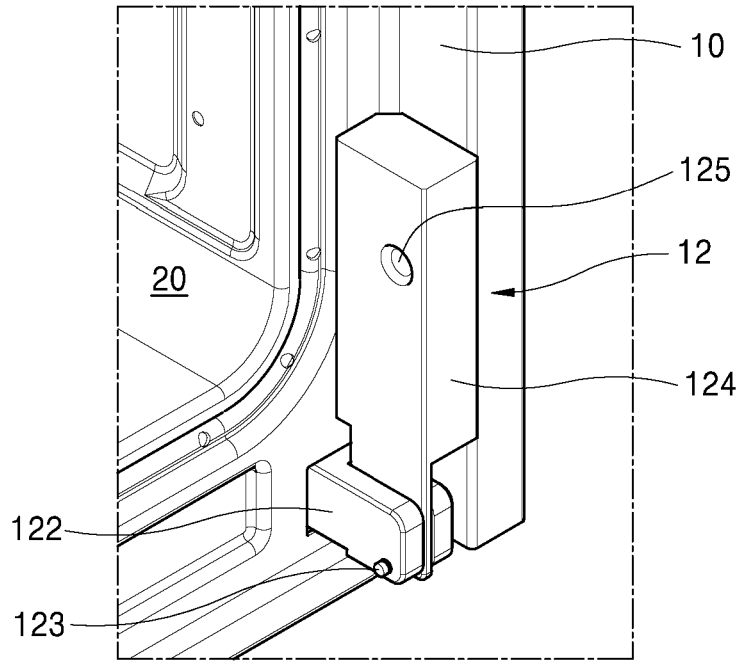

The user may open and close the door 30 with a handle 40 of the door 30. According to one embodiment of the present invention, the handle 40 is provided at an upper right side of a front surface of the door 30. As shown in FIG. 3, when viewing of a front surface of the cooking apparatus, the handle 40 is provided at a first corner, which is an upper right side of the door 30, based on a rectangular shaped door.

Figure 13:
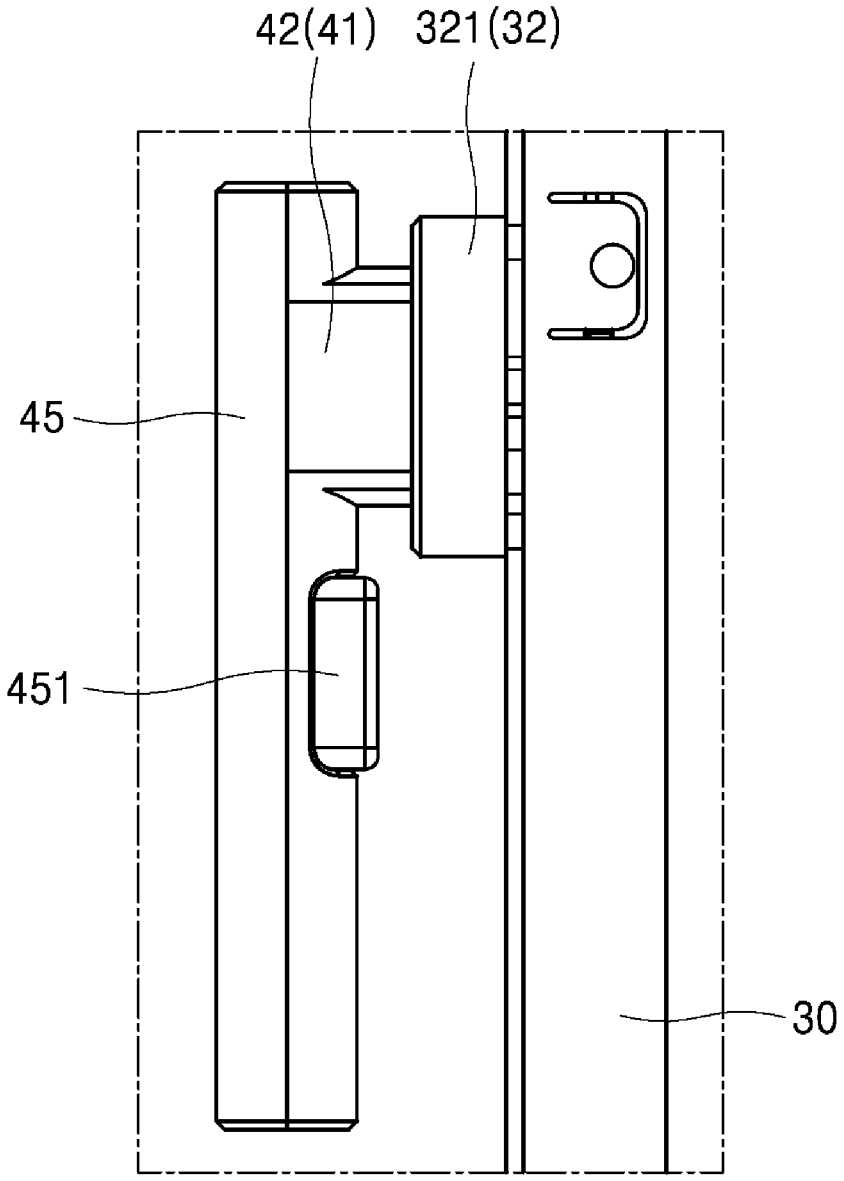
FIG. 13 is a side view of a handle installed at the door.
Figure 14:
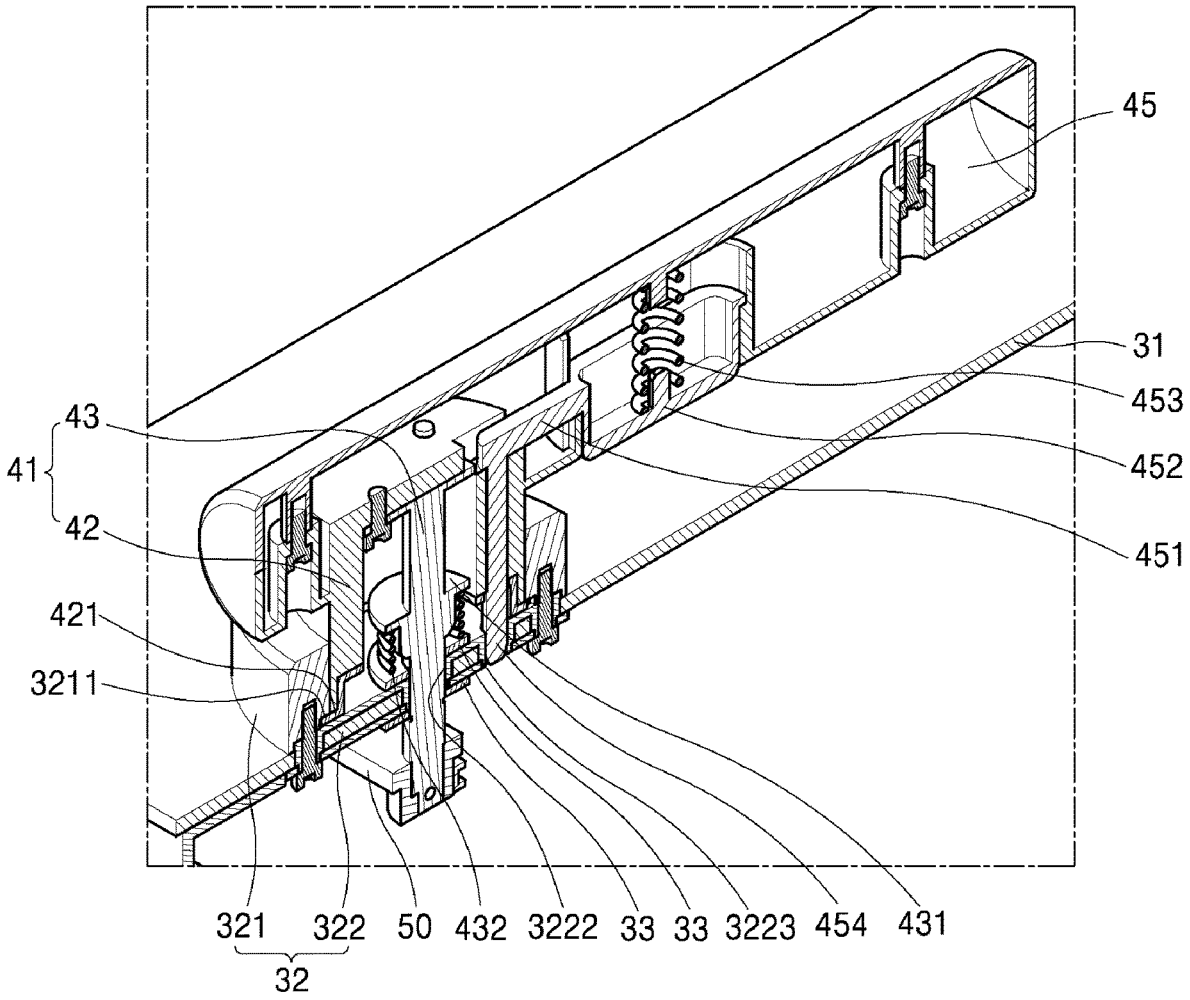
FIG. 14 is a perspective cross-sectional view illustrating a state in which a switch is not pushed in FIG. 13.
Figure 15:
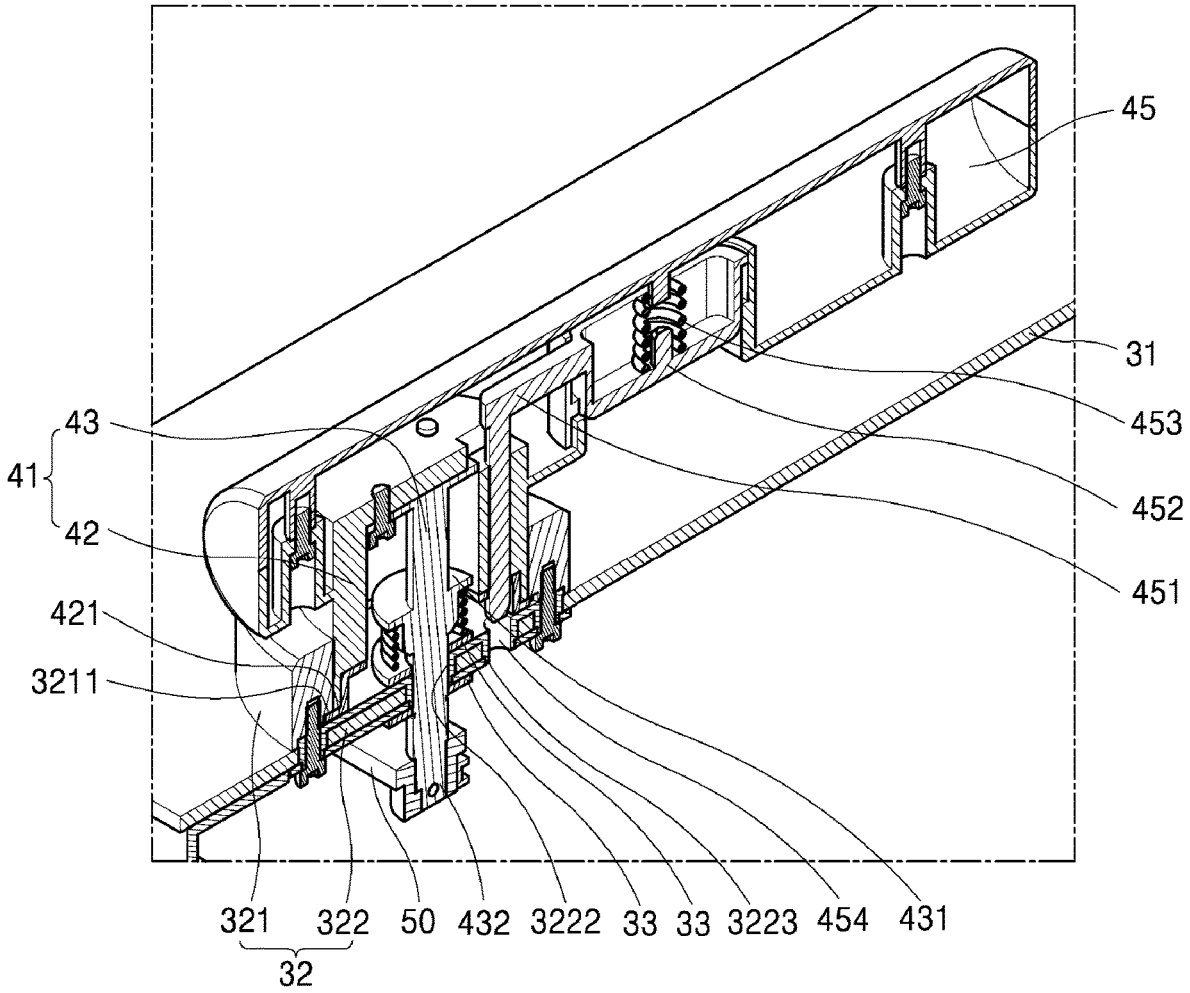
FIG. 15 is a view illustrating a state in which the switch is pushed in FIG. 14.
Figure 16:
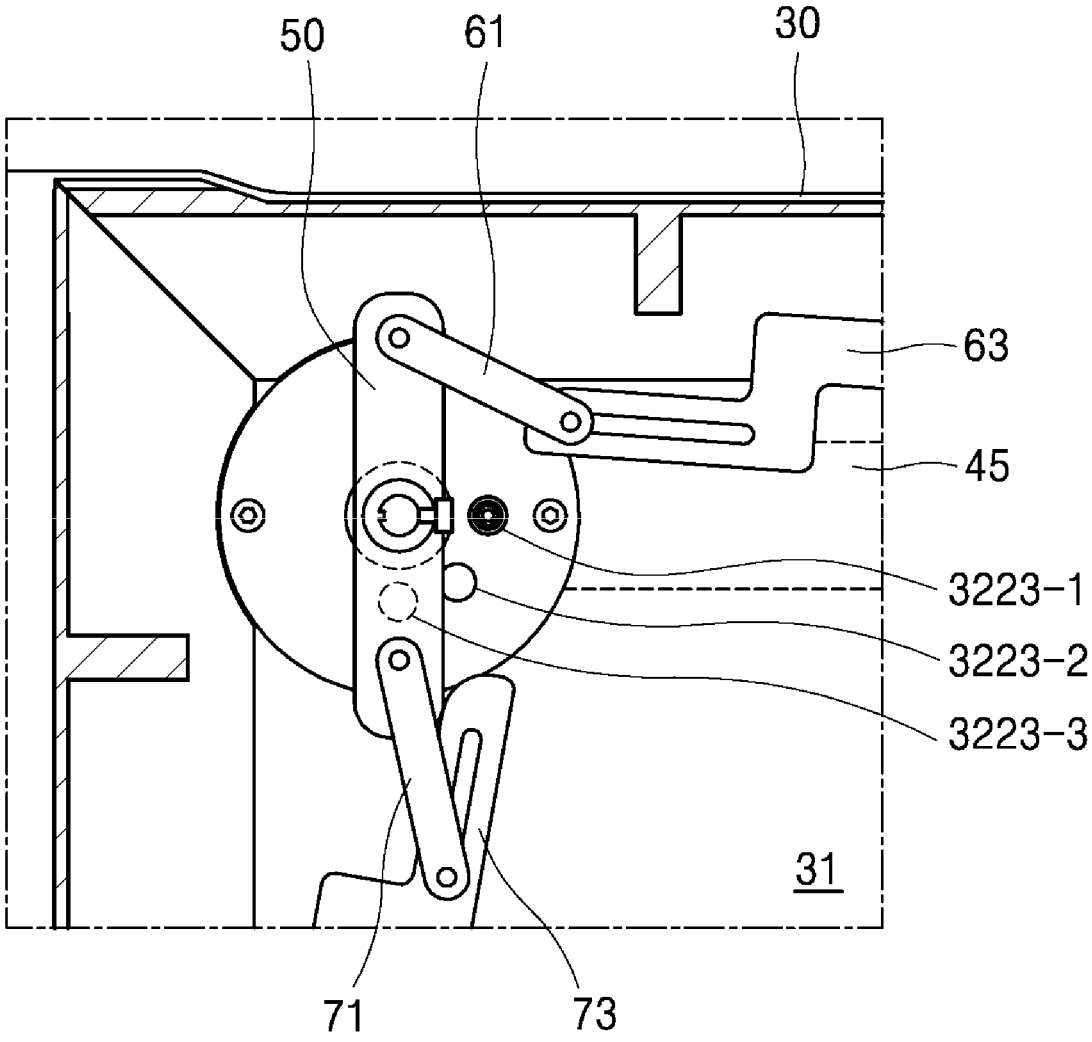
FIG. 16 is a rear view illustrating a part of the door at which the handle is installed in FIG. 13.

The handle 40, as shown in FIG. 13, has a shape in which a grip portion 45 extends toward one side from a center of a handle shaft 41. Also, the handle 40 may rotate around the handle shaft 41.

According to one embodiment of the present invention, depending on a direction in which the grip portion 45 is located, the door 30 may be opened and closed by the pull-down method or may be opened and closed by the side-swing method, or may be locked.

Figure 10:
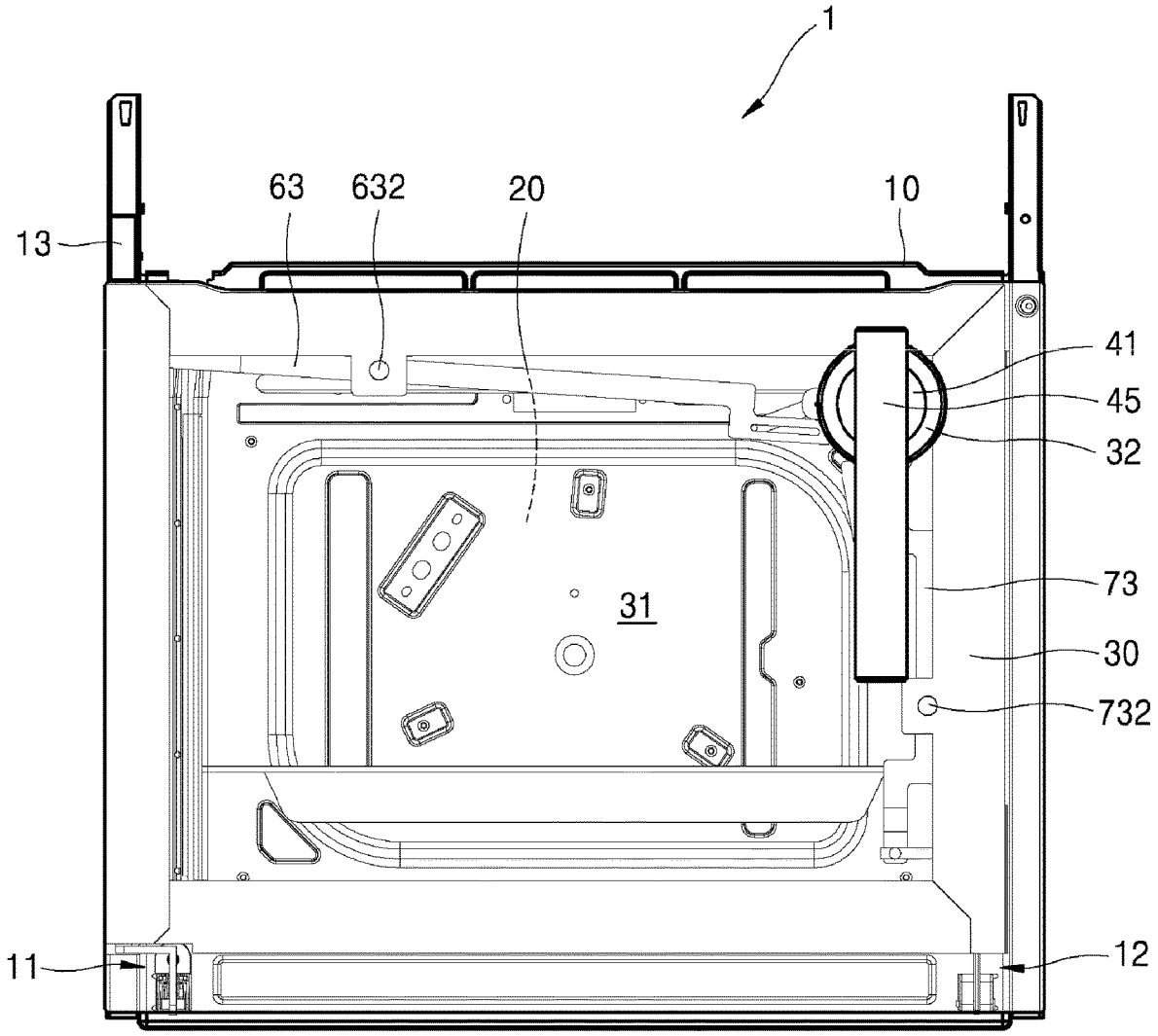
FIG. 10 is a front view illustrating a state in which the door of FIG. 9 is installed in a body and closed.

As shown in FIG. 3, when the grip portion 45 of the handle 40 is rotated to be horizontal, the door 30 is opened and closed by the pull-down method. When the grip portion 45 is rotated by rotating the handle 40 to be perpendicular, as shown in FIG. 10, the door 30 is opened and closed by the side-swing method. Also, when the grip portion 45 is rotated by rotating the handle 40 to be in a direction between horizontal and perpendicular directions, that is, to be tilted, the door 30 is locked and to not be opened or closed.

The handle 40 is provided to be rotatable between a position at which the grip portion 45 is horizontal, that is, a pull-down position, and a position at which the grip portion 45 is perpendicular, that is, a side-swing position. Also, a position at which the door 30 is locked is provided on the middle of a path between the pull-down position and the side-swing position of the grip portion 45.

When the grip portion 45 of the handle 40 is horizontal, as shown in FIG. 3, it is most natural for a user to pull the door 30 downward when holding the grip portion 45 of the handle 40. Likewise, when the grip portion 45 of the handle 40 is perpendicular, as shown in FIG. 10, it is most natural for the user to swing the door 30 sideward when holding the grip portion 45 of the handle 40. That is, the position of the handle 40 and opening and closing directions of the door 30 are very intuitive for the user.

Figure 8:
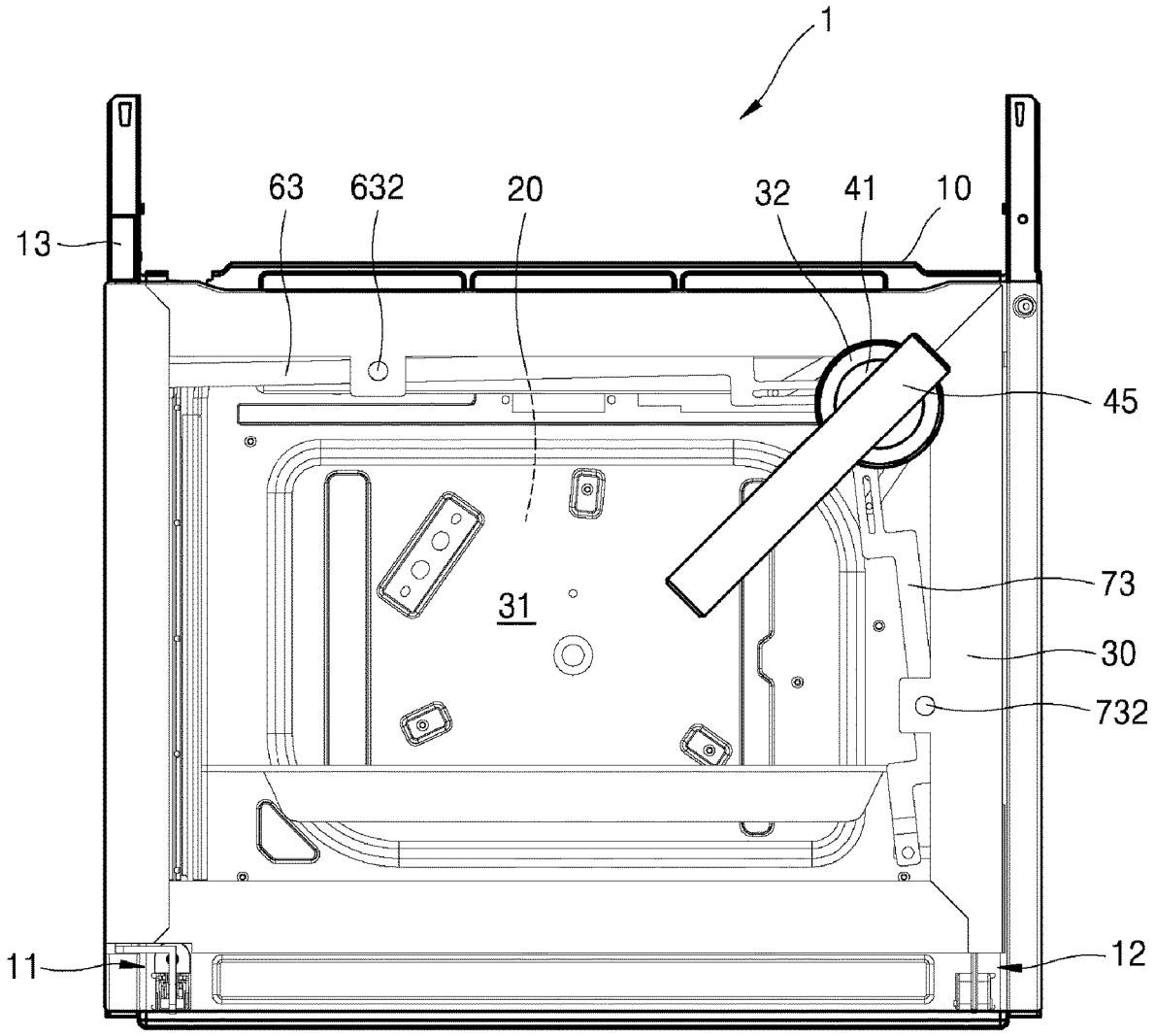
FIG. 8 is a front view illustrating a state in which the door of FIG. 7 is installed in the body and closed.

Likewise, when the grip portion 45 of the handle 40 is diagonally disposed, as shown in FIG. 8, opening and closing the door becomes ambiguous in any direction. That is, when the grip portion 45 of the handle 40 is diagonally disposed, as shown in FIG. 8, the user rotates the grip portion 45 to be horizontal to open the door in a pull-down direction and rotates the grip portion 45 to be perpendicular to open the door in a side-swing direction, and these rotations may be very intuitively performed.

Meanwhile, if the handle 40 is rotated and the grip portion 45 is moved while the door 30 is being opened and closed or locked, it would be inconvenient to use the handle 40. That is, it is more convenient for the user when the handle 40 is fixed to a certain degree at the position at which the grip portion 45 of the handle 40 is horizontal (the pull-down position), at the position of being perpendicular (the side-swing position), and at the position of being diagonal (a locked position).

Referring to FIGS. 13 to 16, the handle 40 and a structure of a handle base 32 that supports the handle 40 will be described.

The door 30 has an enclosure structure having a certain degree of forward and rearward thickness. Due to glass installed at a front surface and a rear surface of the door 30, it is possible to view the inside of the cavity 20 from the outside when the door 30 is closed.

Glass 31 provided at the front surface of the door 30 includes a hole, and the handle base 32 is fixed to and mounted on the hole. The handle base 32 includes a first base 321 having a ring shape that protrudes a certain degree frontward from a front surface of the glass 31 and a second base 322 inserted into the hole provided at the glass from the rear of the glass 31 and fastened to the first base 321. The first base 321 and the second base 322 are fixed to each other by using screws and the like, and the glass 31 is tightly caught therebetween.

The handle 40 includes the handle shaft 41 inserted into the handle base 32 to support a rotation motion and the grip portion 45 that extends in one direction from an end of the handle shaft 41.

The handle shaft 41 includes an external diameter member 42 inserted into the first base 321 to allow an external diameter portion thereof to be fitted to an internal diameter portion of the first base 321 and a shaft portion 43 that passes through a through hole 3222 of the second base 322 in a center of the external diameter member 42.

An outward holding flange 421 having a flange shape facing outwards in a radial direction is provided at an end of the external diameter member 42 which faces the glass 31.

The outward holding flange 421 may be manufactured as an additional component independent of the external diameter member 42 and fixed to the end of the external diameter member 42.

At a part of the internal diameter portion of the first base 321 which faces the glass 31, an internal diameter step 3211 that accommodates the outward holding flange 421 is provided. Accordingly, the external diameter member 42 may be rotated while being guided by the first base 321 and may be prevented from being deviated from the first base 321 due to a holding structure of the outward holding flange 421 and the internal diameter step 3211.

A handle link 50, which is one component of a double hinge operation structure 5 which will be described below, is fixed to an end of the shaft portion 43 that passes through the second base 322. The handle link 50 is fixed to the shaft portion 43 to extend in a direction perpendicular to an extension direction of the shaft portion 43.

A wear-resistant washer 33 to be inserted into the shaft portion 43 is installed at each of a front surface and a rear surface of the second base 322 through which the shaft portion 43 passes.

Although not shown in the drawings, a C ring may be inserted into a groove provided at an outer circumferential surface of the shaft portion 43 from an more inward side than the wear-resistant washer 33 located at the rear surface of the glass 31, that is, closer to the handle link 50. Since the C ring interferes with the wear-resistant washer 33, the shaft portion 43 is prevented from being deviated outward from the second base 322, that is, deviated forward from the cooking apparatus.

A first elastic body 432 is disposed between the wear-resistant washer 33 located at the front surface of the glass 31 and an outward flange 431 that extends outward from a certain position of the shaft portion 43. The first elastic body 432 may be a compression coil spring.

The first elastic body 432 pressurizes the shaft portion 43 in a direction receding frontward from the glass 31. Accordingly, even when a tolerance is slightly accumulated during a process of manufacturing or assembling the handle 40, rattling may be prevented by the first elastic body 432.

A pair of such wear-resistant washer 33 prevents the second base 322 from being worn by friction even when the handle 40 is repeatedly rotated.

When viewed from an inside of the grip portion 45, that is, in a front view, a switch 451 is installed on a rear surface of the grip portion 45. The switch 451 includes a pushing portion 452 pressurized by a second elastic body 453 to protrude more rearward than the rear surface of the grip portion 45, and a holding hook 454 integrated with the pushing portion 452 and passing through the handle shaft 41 to extend forward and rearward.

A holding hole 3223 into or from which the holding hook 454 is inserted or removed is provided at a certain position of the second base 322 corresponding to a path on which the holding hook 454 is turned as the handle 40 is rotated. A plurality of such holding holes 3223 may be provided, and three holding holes 3223 are provided in the embodiment. For example, a pull-down position hole 3223-1 is provided at a position of the second base 322 corresponding to a position of the holding hook 454 when the grip portion 45 of the handle 40 is positioned to be in the horizontal direction. Also, a locking position hole 3223-2 is provided at a position of the second base 322 corresponding to a position of the holding hook 454 when the grip portion 45 of the handle 40 is positioned to be in a diagonal direction. Also, a side-swing position hole 3223-3 is provided at a position of the second base 322 corresponding to a position of the holding hook 454 when the grip portion 45 of the handle 40 is positioned to be in the perpendicular direction.

Since the holding hole 3223 is concealed by the external diameter member 42 through which the holding hook 454 passes, the holding hole 3223 is not visible from the outside.

Since the holding hook 454 is pressurized by the second elastic body 453 in a direction of being inserted into the holding hole 3223, the handle 40 is completely fixed to the door 30 unless the pushing portion 452 is pushed while the holding hook 454 is inserted into the holding hole 3223. On the other hand, when a user wants to turn the handle 40, the user may push the pushing portion 452 while gripping the grip portion 45 to allow the holding hook 454 to be deviated from the holding hole 3223, and then may turn the handle 40.

According to one embodiment of the present invention, a direction of the grip portion 45 of the handle 40 and the opening and closing directions of the door 30 are intuitively associated with each other. However, when a general rack and pinion structure or cam and spring structure is applied, position changing operations of a hinge for converting among the directions of the grip portion 45 of the handle 40 (the perpendicular, horizontal, and diagonal directions) and the opening and closing directions of the door 30 (the pull-down and side-swing directions) are not well connected. Also, when a general rack and pinion structure or cam and spring structure is applied, it is necessary for a user to turn the handle with excessive force. Accordingly, related components may be easily worn and damaged.

On the other hand, when a following link structure is applied, the position changing operations for converting among the directions of the grip portion 45 of the handle 40 and the opening and closing directions of the door 30 may be associated with each other. Also, since the user can easily turn the handle 40, service lives of the related components may be further extended.

In addition, when the link structure is applied to the handle, it is possible to prevent position changing operations of the hinge for converting the opening and closing directions of the door in a certain section of a path on which the handle 40 is rotated. Particularly, this structure allows both an upper side-swing hinge shaft 65 and a following pull-down bar 75, which will be described below, to protrude lengthwise when the handle 40 is at the locked position, thereby completely locking the door 30. Also, there is no concern about total deviation of the door 30 from the body 10 due to both the upper side-swing hinge shaft 65 and the pull-down bar 75 retracting into the door 30 among operations for converting the opening and closing directions of the door 30.

According to the above-described embodiment, the directions of the grip portion 45 include the horizontal, perpendicular, and diagonal directions. However, it should be obvious that the scope of the present invention is not limited thereto.

[Double Hinge Operation Structure]

Hereafter, the double hinge operation structure 5 applied to the door 30 according to one embodiment of the present invention will be described with reference to the drawings.

The double hinge operation structure 5 is located on the rear side of the glass 31 at the door 30. For convenience of description and understanding, although not shown in the drawings, a part of the glass 31 at which the double hinge operation structure 5 is disposed is processed to be opaque via printing and the like to prevent exposure of the double hinge operation structure 5 to the outside.

Also, links and components used in the double hinge operation structure 5 may be manufactured by using highly heat-resistant metal material in consideration of a relatively high temperature environment inside the door 30. Also, the links may be formed of thin plate-shaped members so as not to interfere with a flow of cooling air inside the door 30.

On the rear side of the glass 31, the handle link 50, which is fixed to the above-described shaft portion 43 of the handle 40 to be rotated with the shaft portion 43, is installed.

The handle link 50 mechanically transfers an operation to the first swing hinge shaft 65 and the pull-down bar 75 provided at a second corner and a third corner of the door 30 from two different places.

<Interworking Structure of Handle Link and First Swing Hinge Shaft>

First, in a rectangular door, a structure which transfers an operation to the first swing hinge shaft 65 provided at the second corner horizontally next to the first corner at which the handle link 50 is provided will be described.

The first swing hinge shaft 65 at the second corner slides upward or downward to protrude vertically from or be hidden in an upper side of the door 30. That is, the swing hinge shaft 65 is the upper side-swing hinge shaft that protrudes upward to support side-swing type opening and closing of the door 30.

The first swing hinge shaft 65 is inserted into a frame of the door 30 which passes vertically through the door 30, and is guided to slide vertically.

The handle link 50 and the first swing hinge shaft 65 are connected by a first main link 63. One end of the first main link 63 is rotatably connected to the handle link 50, and the other end of the first main link 63 is rotatably connected to the first swing hinge shaft 65.

A first rotation supporting point 632 that rotatably fixes the first main link 63 to the door 30 is provided at an intermediate point between the one end and the other end of the first main link 63. Accordingly, the first main link 63 pivots around the first rotation supporting point 632. When the first main link 63 pivots around the first rotation supporting point 632, the other end of the first main link 63 has a circular arc-shaped path while the first swing hinge shaft 65 has a linear path. Accordingly, in spite of the different movement paths thereof, it is necessary to convert an operation of the circular arc-shaped path of the first main link 63 into an operation of the linear path of the first swing hinge shaft 65.

Figure 2A:
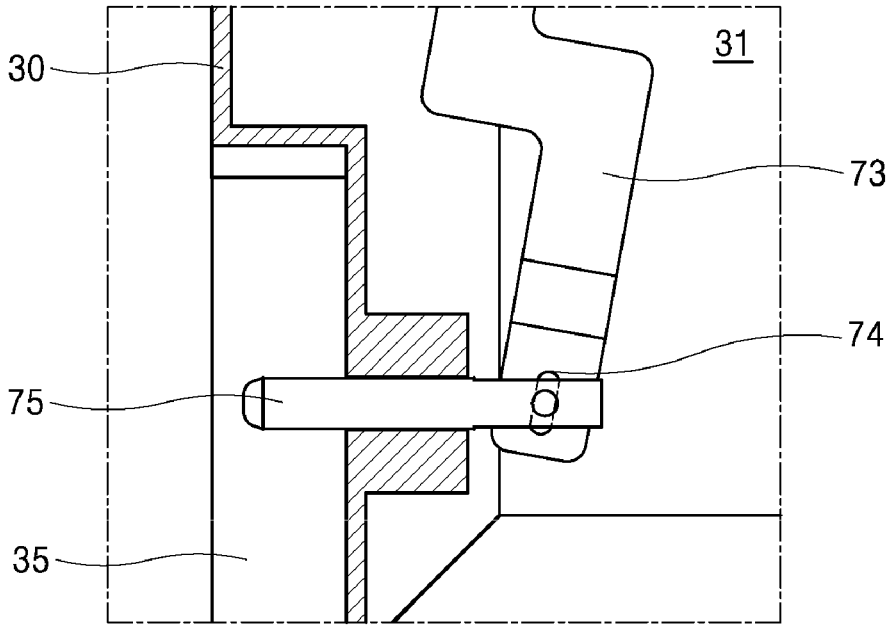
FIGS. 2A and 2B are enlarged views illustrating part 'a' and part 'b' in FIG. 1, respectively.
Figure 2B:
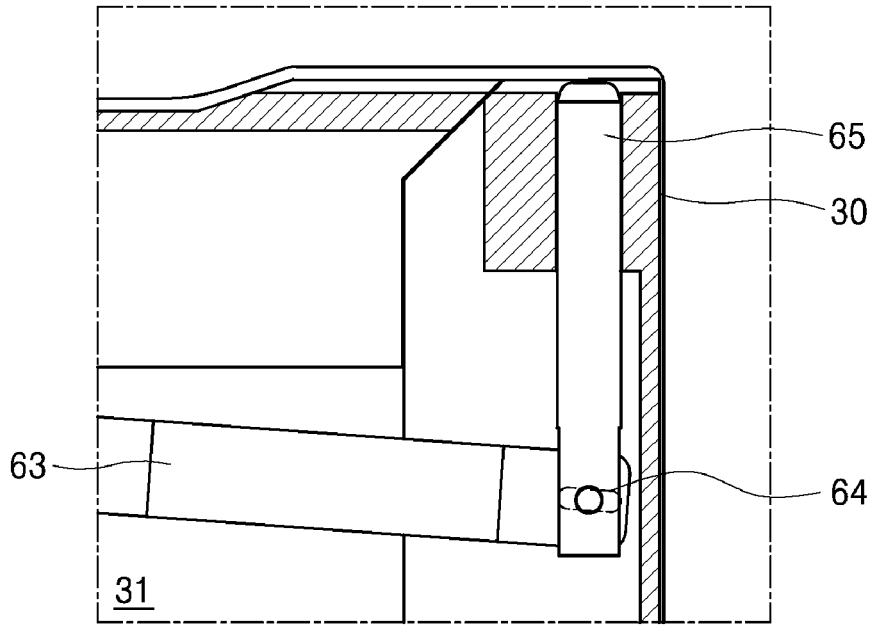

For this, according to one embodiment of the present invention, a structure in which a swing hinge side long hole 64 is formed at the other end of the first main link 63 rotatably connected to the first swing hinge shaft 65, as shown in FIG. 2B, and a pin that passes through the first swing hinge shaft 65 passes through the long hole 64 is provided. The long hole 64 has a length that accommodates a deviation between the other end of the first main link 63 and the path of the first swing hinge shaft 65.

As a modified example thereof, although not shown in the drawing, a structure in which the first swing hinge shaft 65 is formed in a T shape and a long hole that extends leftward and rightward is formed therein is also applicable. However, forming the long hole at the first main link is more preferable from a viewpoint of simplifying shapes of components thereof.

The first main link 63 and the first swing hinge shaft 65 are slidably and rotatably connected by the long hole 64.

Next, the one end of the first main link 63 also has a circular arc-shaped path with the first rotation supporting point 632 as a center while the handle link 50 has a circular arc-shaped path with the shaft portion 43 of the handle 40 as a center. Accordingly, it is necessary to provide a long hole in at least one of the first main link 63 and the handle link 50 for interworking between the first main link 63 and the handle link 50.

For this, according to one embodiment of the present invention, a structure in which a first handle-side long hole 62 is formed at an end of the first main link 63 is provided. The long hole 62 may be provided along a longitudinal direction of the first main link 63 to accommodate a difference in paths of the first main link 63 and the handle link 50.

The first handle-side long hole 62, as described in the embodiment, may be provided at the first main link 63 and may be additionally provided at the handle link 50, or may be provided at both the first main link 63 and the handle link 50.

The handle link 50 and the first main link 63 are slidably and rotatably connected by the long hole 62.

Figure 1:
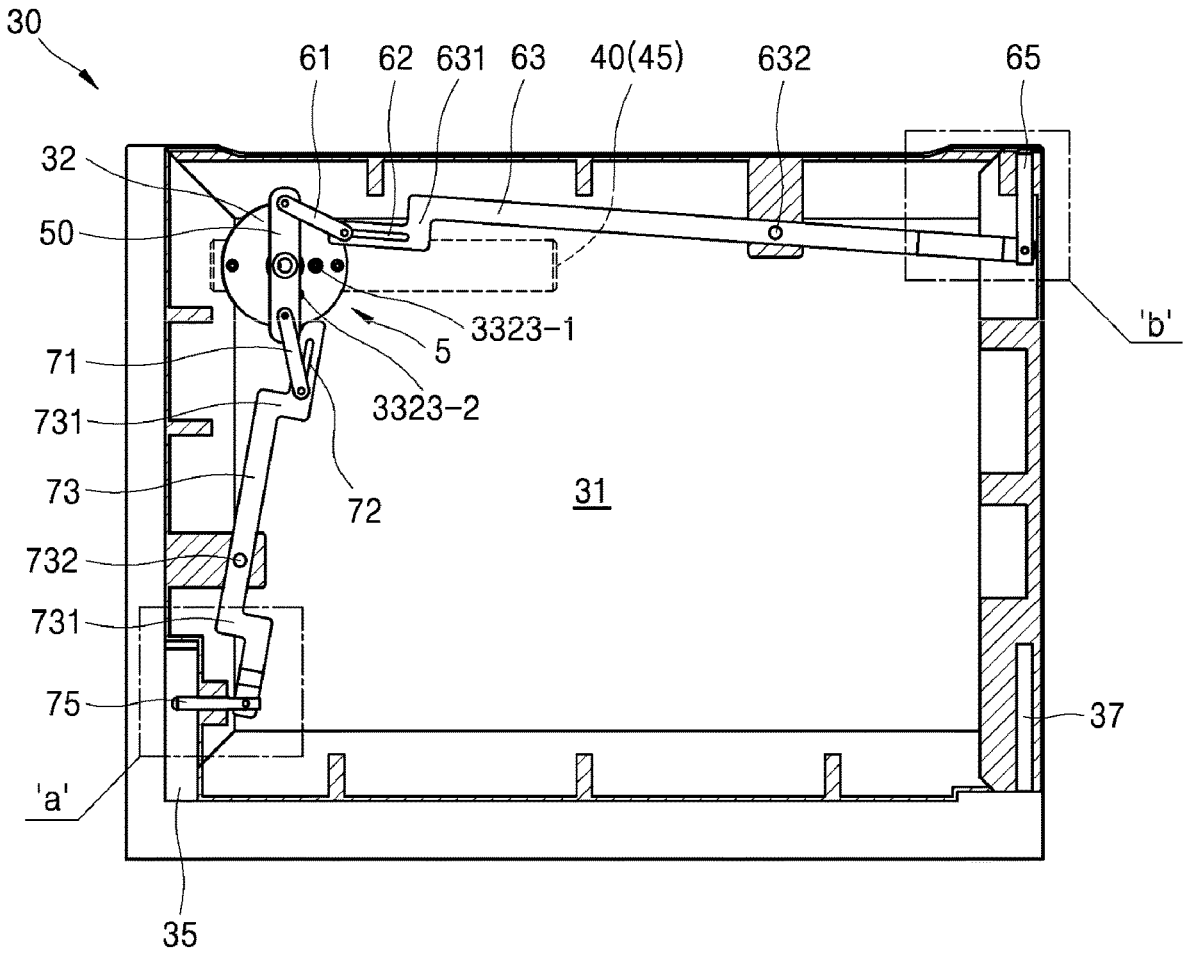
FIG. 1 is a rear view illustrating a state in which a door according to one embodiment of the present invention is openable using a pull-down method.
Figure 7:
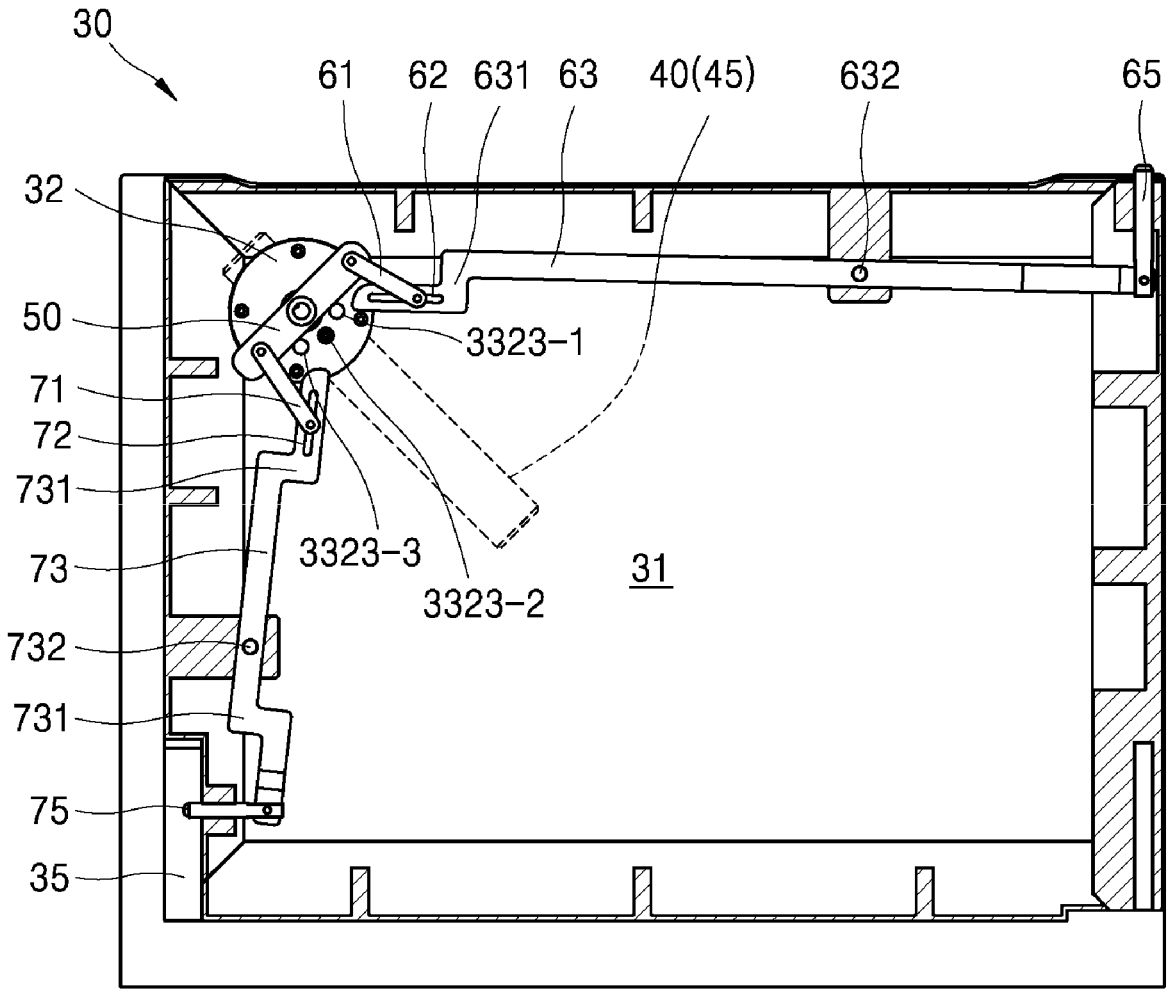
FIG. 7 is a rear view illustrating a state in which the door is at a locking position.

In addition, according to one embodiment of the present invention, the first swing hinge shaft 65 retracts into a side of the door 30 to be hidden, as shown in FIG. 1, when the grip portion 45 of the handle 40 is horizontally positioned to pull the door 30 downward and open the door. Also, the first swing hinge shaft 65 protrudes from the side of the door 30, as shown in FIG. 7, when the grip portion 45 of the handle 40 is diagonally positioned to lock the door 30. Also, the first swing hinge shaft 65 protrudes from the side of the door 30, as shown in FIG. 9, when the grip portion 45 of the handle 40 is perpendicularly positioned to swing the door 30 sideward and open the door.

Figure 9:
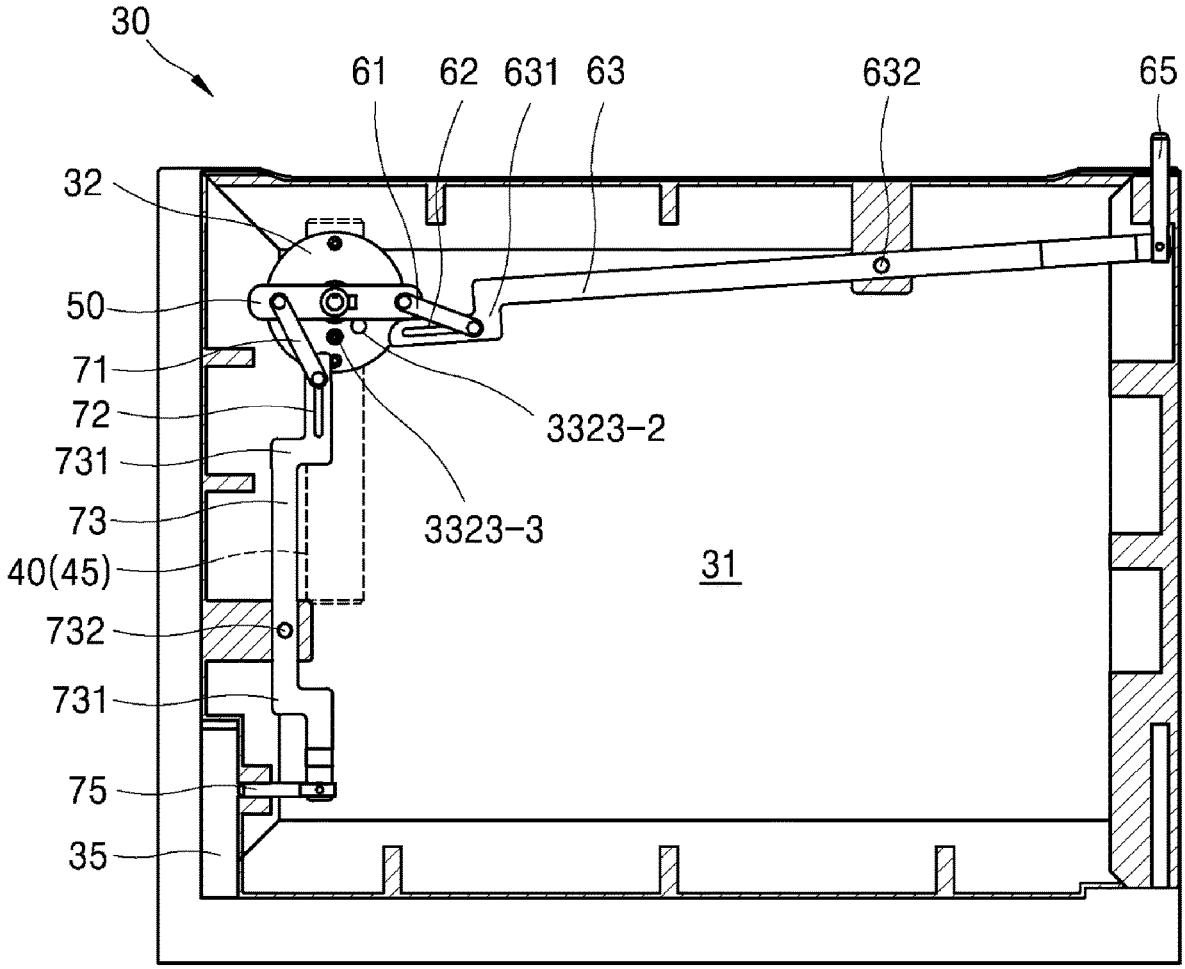
FIG. 9 is a rear view illustrating a state in which a door according to one embodiment of the present invention is openable using a side-swing method.

For this, according to one embodiment of the present invention, a structure in which the first swing hinge shaft 65 slides to protrude vertically from or be hidden under the first handle-side long hole 62, which is provided in at least one of the first main link 63 and the handle link 50, while the handle link 50 is rotated by 90 degrees between the positions shown in FIGS. 1 and 9 is applicable.

Meanwhile, when the first main link 63 and the handle link 50 are directly connected to each other, a geometric limitation in design may occur such that a degree of freedom in design may be narrowed. Also, the first main link 63 and the handle link 50 necessarily become an interworking structure in which a rotational displacement of the handle link 50 and a sliding displacement of the first swing hinge shaft 65 are approximately linearly proportional to each other.

For this, according to one embodiment of the present invention, a structure in which the first main link 63 and the handle link 50 are connected by a first intermediate link 61 (which is omissible) is further provided.

According to this structure, the rotational displacement of the handle link 50 is not directly transferred to the first main link 63 and is transferred through the first intermediate link 61. Accordingly, it is possible to design the handle link 50 such that the rotational displacement of the handle link 50 is intensively transferred or not transferred to the first swing hinge shaft 65 depending on how first intermediate link 61 is designed to move.

Also, according to this structure, since the first intermediate link 61 is disposed between the handle link 50 and the first main link 63 to increase a degree of freedom in design, it is possible to precisely design a position of the handle 40 and a preferable position of the first swing hinge shaft 65 corresponding thereto.

For example, since the first intermediate link 61 is moved along the first handle-side long hole 62 while the handle 40 is rotated from the position shown in FIG. 1 to a position shown in FIG. 7, an amount of rotation of the first main link 63 is small such that the sliding displacement of the first swing hinge shaft 65 may be small. On the other hand, since the first intermediate link 61 reaches an end of the first long hole 62 and then rotates the first main link 63 by a large amount while the handle 40 is rotated from the position shown in FIG. 7 to the position shown in FIG. 9, the sliding displacement of the first swing hinge shaft 65 may be greater.

In one embodiment of the present invention, although a motion transferred to the first swing hinge shaft 65 is designed to be greater in a section in which the handle 40 is rotated from the position shown in FIG. 7 to the position shown in FIG. 9 than in a section in which the handle 40 is rotated from the position shown in FIG. 1 to the position shown in FIG. 7, it is possible to design for the opposite situation. That is, it is possible to set a displacement to which the first swing hinge shaft 65 protrudes outward to be greater in the section in which the handle 40 is rotated from the position shown in FIG. 1 to the position shown in FIG. 7. When this design is applied, since it is possible to allow both the first swing hinge shaft 65 and the pull-down bar 75 to completely protrude from the side of the door 30 at the locked position of the handle 40, the door 30 may be more completely locked.

Meanwhile, as shown in the drawing, the first main link 63 includes a deflecting portion 631. Since the deflecting portion 631 allows an overall position of the first main link 63 to be disposed closer to a side part of the door 30, the deflecting portion 631 is advantageous for hiding the double hinge operation structure.

<Interworking Structure of Handle Link and Pull-Down Bar>

Next, in the rectangular door, a structure which transfers an operation to the pull-down bar 75 provided at the third corner vertically next to the first corner at which the handle link 50 is provided will be described.

The pull-down bar 75 at the third corner slides leftward and rightward to protrude rightward from or be hidden in a right side of the door 30 when the cooking apparatus is viewed from the front. Although the pull-down bar 75 protrudes from the right side of the door 30 and supports pull-down type opening and closing of the door 30, the pull-down bar 75 is not a pivot center of the pull-down type opening and closing of the door 30.

The pull-down bar 75 is inserted into the frame of the door which passes leftward and rightward through the door 30 and is guided to slide leftward and rightward.

The handle link 50 and the pull-down bar 75 are connected by a second main link 73. One end of the second main link 73 is rotatably connected to the handle link 50, and the other end of the second main link 73 is rotatably connected to the pull-down bar 75.

A position at which the handle link 50 and the second main link 73 are connected may differ from a position at which the handle link 50 and the first main link 63 are connected. In the embodiment, a structure in which the two positions are provided at both ends of the handle link 50 which face each other with a rotational center therebetween is provided. According to the above-described structure, action forces applied to the two links 63 and 73 are at point-symmetrical positions based on a rotational center of the handle 40 when the handle 40 is rotated, and the rotational center of the handle 40 coincides with centers of the two action forces such that pivoting of the handle 40 may be further naturally performed.

Positions at which the two main links 63 and 73 are connected to the handle link 50 may overlap each other.

A second rotation supporting point 732 that rotatably fixes the second main link 73 to the door 30 is provided at an intermediate point between the one end and the other end of the second main link 73. Accordingly, the second main link 73 pivots around the second rotation supporting point 732.

When the second main link 73 pivots around the second rotation supporting point 732, the other end of the second main link 73 has a circular arc-shaped path while the pull-down bar 75 has a linear path. Accordingly, in spite of the different movement paths thereof, it is necessary to convert an operation of the circular arc-shaped path of the second main link 73 into an operation of the linear path of the pull-down bar 75.

For this, according to one embodiment of the present invention, a structure in which a pull-down hinge side long hole 74 is formed at the other end of the second main link 73 rotatably connected to the pull-down bar 75, as shown in FIG. 2A, and a pin that passes through the pull-down bar 75 passes through the long hole 74 is provided. The long hole 74 has a length for accommodating a deviation between the other end of the second main link 73 and the path of the pull-down bar 75.

As a modified example thereof, although not shown in the drawing, a structure in which the pull-down bar 75 is formed in a T shape and a long hole that extends vertically is formed therein is also applicable.

The second main link 73 and the pull-down bar 75 are slidably and rotatably connected by the long hole 74.

Next, the one end of the second main link 73 has a circular arc-shaped path with the second rotation supporting point 732 as a center while the handle link 50 has a circular arc-shaped path with the shaft portion 43 of the handle 40 as a center. Accordingly, it is necessary to provide a long hole in at least one of the second main link 73 and the handle link 50 for interworking between the second main link 73 and the handle link 50.

For this, according to one embodiment of the present invention, a structure in which a second handle-side long hole 72 is formed at an end of the second main link 73 is provided. The long hole 72 may be provided along a longitudinal direction of the second main link 73 to accommodate a difference in the paths of the second main link 73 and the handle link 50.

The second handle-side long hole 72, as described in the embodiment, may be provided at the second main link 73, and may be additionally provided at the handle link 50, or may be provided at both the second main link 73 and the handle link 50.

The handle link 50 and the second main link 73 are slidably and rotatably connected by the long hole 72.

In addition, according to one embodiment of the present invention, the pull-down bar 75 protrudes from the side of the door 30, as shown in FIG. 1, when the grip portion 45 of the handle 40 is horizontally positioned to pull the door 30 downward and open the door. Also, the pull-down bar 75 protrudes from the side of the door 30, as shown in FIG. 7, when the grip portion 45 of the handle 40 is diagonally positioned to lock the door 30. Also, the pull-down bar 75 is hidden in the side of the door 30, as shown in FIG. 9, when the grip portion 45 of the handle 40 is perpendicularly positioned to swing the door 30 sideward and open the door. For this, according to one embodiment of the present invention, a structure in which the pull-down bar 75 slides to protrude rightward or be hidden leftward by the second handle-side long hole 72, which is provided in at least one of the second main link 73 and the handle link 50, while the handle link 50 is rotated by 90 degrees between the positions shown in FIGS. 1 and 9 is applicable.

For this, according to one embodiment of the present invention a structure in which the second main link 73 and the handle link 50 are connected by a second intermediate link 71 (which is omissible) is further provided.

According to this structure, the rotational displacement of the handle link 50 is not directly transferred to the second main link 73 and is transferred through the second intermediate link 71.

For example, since the second intermediate link 71 moves along the second handle-side long hole 72 while the handle 40 is rotated from the position shown in FIG. 9 to the position shown in FIG. 7, an amount of rotation of the second main link 73 is small such that a sliding displacement of the pull-down bar 75 may be small. On the other hand, since the second intermediate link 71 reaches an end of the second long hole 72 and then rotates the second main link 73 by a large amount while the handle 40 is rotated from the position shown in FIG. 7 to the position shown in FIG. 1, the sliding displacement of the pull-down bar 75 may be greater. In one embodiment of the present invention, although a motion transferred to the pull-down bar 75 is designed to be greater in a section in which the handle 40 is rotated from the position shown in FIG. 7 to the position shown in FIG. 1 than in a section in which the handle 40 is rotated from the position shown in FIG. 9 to the position shown in FIG. 7, it is possible to design for the opposite situation.

According to one embodiment of the present invention, when the handle 40 is rotated between the handle positions of FIG. 1 and FIG. 7, a rotational force of the handle 40 is generally applied to the second main link 73. Also, when the handle 40 is rotated between the handle positions in FIG. 7 and FIG. 9, the rotational force of the handle 40 is generally applied to the first main link 63. Accordingly, when the handle 40 is rotated at the handle positions of FIG. 1 and FIG. 7 and the handle 40 is rotated at the handle positions of FIG. 7 and FIG. 9, a force that a user applies to the handle 40 may be evenly dispersed. That is, when turning the handle 40, there is no case in which a greater force is applied to one section and a smaller force is applied to another section.

A motion transferred to the first swing hinge shaft 65 may be designed to differ from a motion transferred to the pull-down bar 75 depending on the rotational displacement of the handle link 50. That is, it is possible to allow degrees of rotational displacement of the handle link 50 transferred to both the first swing hinge shaft 65 and the pull-down bar 75 between the handle positions shown in FIG. 1 and FIG. 7 to be great, and to allow the degrees of the rotational displacement of the handle link 50 transferred to both the first swing hinge shaft 65 and the pull-down bar 75 between the handle positions shown in FIG. 7 and FIG. 9 to be small. However, it the opposite is also possible.

Meanwhile, as shown in the drawing, the second main link 73 includes two deflecting portions 731. Since the deflecting portions 731 allow an overall position of the second main link 73 to be disposed closer to the side of the door 30, the deflecting portions 731 are advantageous for hiding the double hinge operation structure.

[Structure of Two Way-Opening and Closing Door]

Hereafter, an operation principle in which the door 30 is opened and closed by the double hinge operation structure installed in the door 30 will be described.

The handle 40 is installed at the first corner of the door 30, the upper side swing hinge shaft, that is, the first swing hinge shaft 65, is installed at the second corner thereof, and the pull-down bar 75 is installed at the third corner thereof. Also, depending on the position of the handle 40, the first swing hinge shaft 65 and the pull-down bar 75 selectively appear or disappear at the side of the door 30.

Figure 12A:
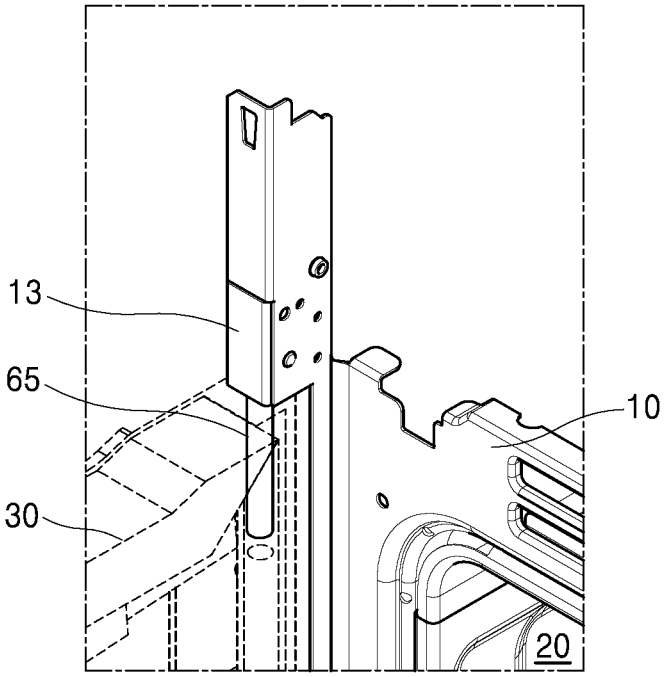
FIGS. 12A and 12B are enlarged views illustrating part 'g' and part 'h' in FIG. 11, respectively.

As shown in FIG. 12A, a hinge guide 13 into which the first swing hinge shaft 65 is inserted when the first swing hinge shaft 65 protrudes upward from the door 30 (refer to FIGS. 7 and 9) is provided at the top of the front surface of the body 10 to correspond to the second corner of the door 30. The hinge guide 13 may have a structure in which a hole that accommodates the first swing hinge shaft 65 is vertically formed.

A pull-down hinge 12 is provided at the front surface of the body 10 to correspond to the third corner of the door 30. The pull-down hinge 12 includes a second pull-down body 122 fixed to the body 10 and a second bracket 124 installed at the second pull-down body 122 to be rotatable in the pull-down direction through a second pull-down hinge 123.

A pull-down bar fastening hole 125 into which the pull-down bar 75 is inserted when the pull-down bar 75 protrudes from the door 30 is provided at a side of the second bracket 124. The second bracket 124 has a rectangular parallelepiped shape that is elongated upward, and a second bracket accommodation portion 35 on which the second bracket 124 is fit is provided at a side of the third corner of the door 30. When the pull-down bar 75 is inserted into the pull-down bar fastening hole 125 while the second bracket 124 is accommodated in the second bracket accommodation portion 35 of the door 30, relative movements between the door 30 and the second bracket 124 are restricted.

Due to a buffering assembly 15 installed behind the second pull-down body 122, the second bracket 124 is elastically moved in an upward direction with respect to the second pull-down body 122. This is to prevent a phenomenon in which the door 30 quickly drops due to its own weight when being opened using the pull-down method, and the buffering assembly 15 may include a spring and a damper.

A second swing hinge shaft insertion portion 37 is provided at a fourth corner of the door 30 located diagonal to the first corner thereof. The second swing hinge shaft insertion portion 37 has a hole or groove shape having a circular cross section which is open downward and vertically extends is provided collinearly with the first swing hinge shaft 65.

A mixed hinge 11 is provided at the front surface of the body 10 to correspond to the fourth corner of the door 30. The mixed hinge 11 includes a first pull-down body 112 fixed to the body 10 and a first bracket 114 installed at the first pull-down body 112 to be rotatable in the pull-down direction by a first pull-down hinge 113.

The first bracket 114 has a structure in which a metal plate is bent in an "L" shape which has a vertical portion and horizontal portion, as shown in the drawing. A vertical portion of the first bracket 114 is hinge-coupled to the first pull-down body 112, and a lower side swing hinge shaft, that is, a second swing hinge shaft 115 that extends upward, is provided on a top surface of the horizontal portion. The second swing hinge shaft 115 is inserted into the second swing hinge shaft insertion portion 37 and supports the door 30 to rotate around the second swing hinge shaft 115.

In the embodiment of the present invention, a structure in which the hole 37 is provided at the door 30 and the shaft 115 is provided at the mixed hinge 11 has been described as an example. However, positions of the hole and the shaft may be changed.

Due to a buffering assembly (not shown) installed behind the first pull-down body 112, the first bracket 114 is elastically moved in an upward direction with respect to the first pull-down body 112. This is to prevent a phenomenon in which the door 30 quickly drops due to its own weight when being opened using the pull-down method, and the buffering assembly may include a spring and a damper.

The fourth corner of the door 30 is coupled to the body 10 by the second swing hinge shaft 115 and the first pull-down hinge 113 to be rotatable using the pull-down method or the side-swing method.

As shown in FIGS. 1 and 3, when the grip portion 45 is horizontal, that is, when the handle 40 is at the pull-down position, the first swing hinge shaft 65 is hidden in the door 30 and retracts from the hinge guide 13, and the pull-down bar 75 protrudes from the side of the door 30 and is inserted into the pull-down bar fastening hole 125 of the second bracket 124.

Figure 6A:
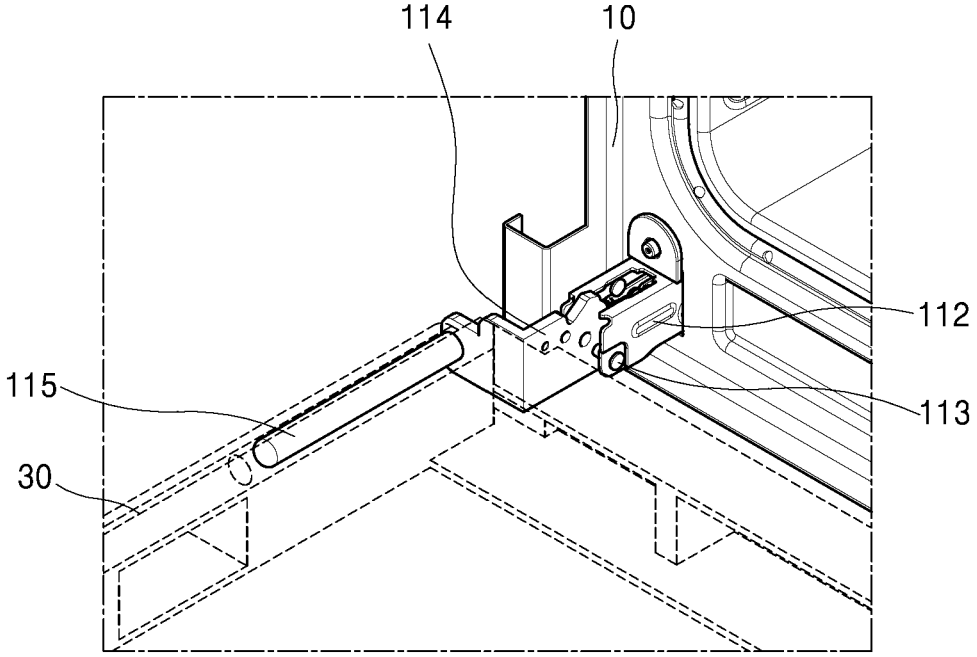
FIGS. 6A and 6B are views illustrating part 'e' and part 'f' in FIG. 5 in which the door is omitted and illustrating positions of the mixed hinge and the pull-down hinge installed at the bottom of the body while the door is opened in the pull-down direction.
Figure 6B:
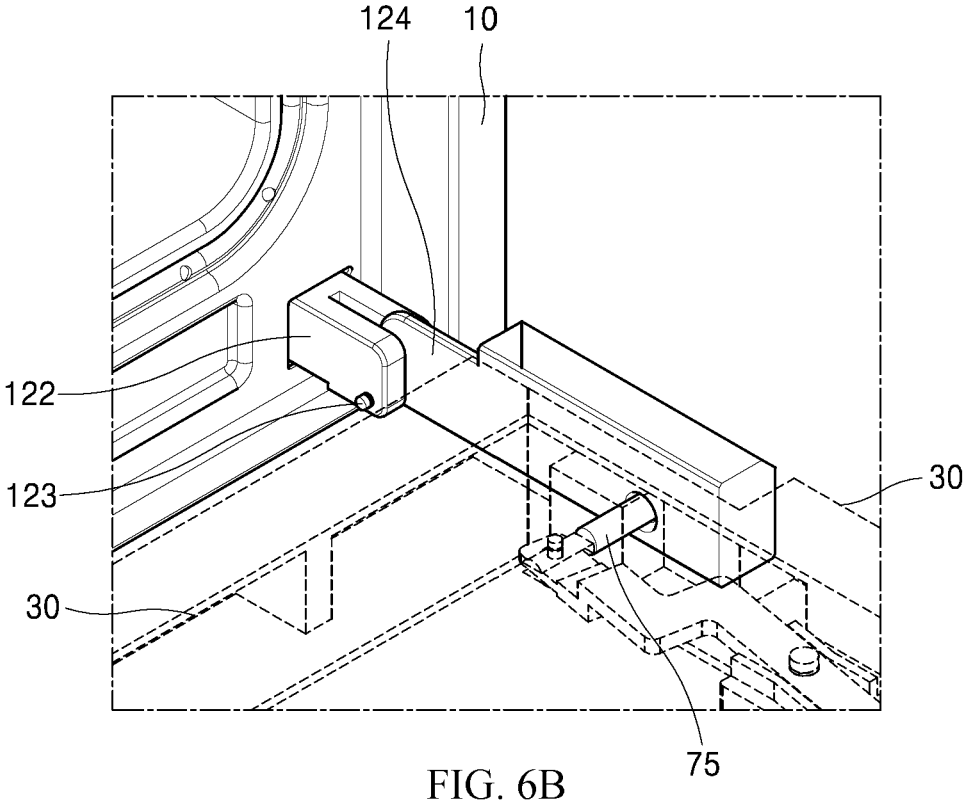

Accordingly, as shown in FIGS. 5, 6A, and 6B, the door 30 may be rotatably opened using the pull-down method while being supported by the two hinges 11 and 12 provided at the bottom of the body 10, at the third corner and the fourth corner, and may be gradually opened by the buffering assembly 15.

According to one embodiment of the present invention, the pull-down bar 75 is not a rotational center of the door 30 when the door 30 is opened and closed in the pull-down direction, but functions as a component that fastens or releases the door 30 to or from the second bracket 124. Also, a pull-down rotation of the door 30 with respect to the body 10 is performed on the basis of the second pull-down hinge 123. This is a structure adequate for applying a structure in which the buffering assembly 15 supports the door 30 to gradually open the door 30, thereto.

Next, as shown in FIGS. 7 and 8, when the grip portion 45 is tilted, that is, when the handle 40 is at the locked position, the first swing hinge shaft 65 protrudes vertically from the door 30 and is inserted into the hinge guide 13, and the pull-down bar 75 protrudes from the side of the door 30 and is inserted into the pull-down bar fastening hole 125 of the second bracket 124. Accordingly, the door 30 remains in a state of being fixed to the body, not opened, and locked at the second corner, the third corner, and the fourth corner, which are not collinear.

Next, as shown in FIGS. 9 and 10, when the grip portion 45 is perpendicular, that is, when the handle 40 is at the side-swing position, the first swing hinge shaft 65 protrudes vertically from the door 30 and is inserted into the hinge guide 13 and the pull-down bar 75 is hidden in the door 30 and retracts from the pull-down bar fastening hole 125 such that the door 30 is separated from the second bracket 124.

Figure 12B:
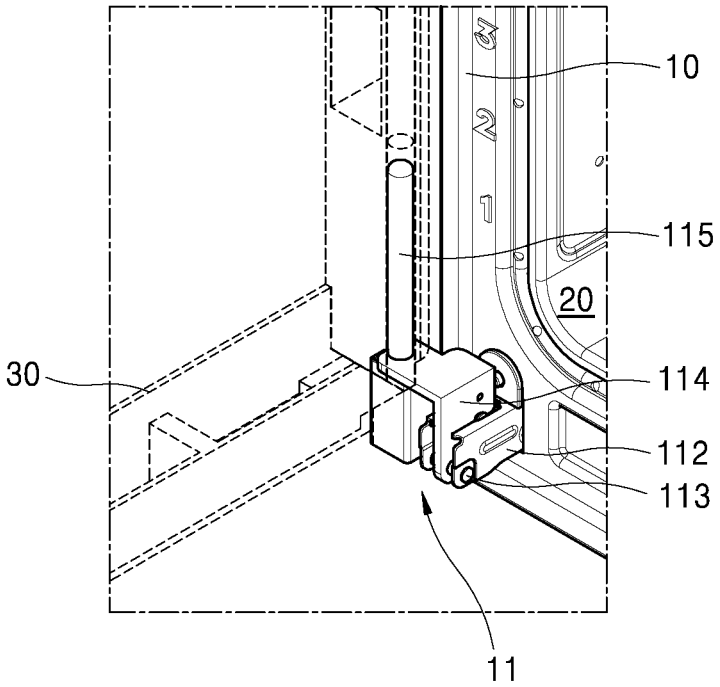

Accordingly, as shown in FIGS. 11, 12A, and 12B, the door 30 may be rotatably opened using the side-swing method while being supported by the first swing hinge shaft 65 and the second swing hinge shaft 115 at the second corner and the third corner, respectively.

A door structure according to one embodiment of the present invention may allow an operation direction of a door to be selected using a simple structure and may secure reliability of operation.

A door structure according to one embodiment of the present invention may smoothly perform a link operation by two link units having different paths in a link structure and being connected through a long hole.

A door structure according to one embodiment of the present invention may allow a position of a handle to be relatively freely designed to correspond to an opening direction of a door.

A door structure according to one embodiment of the present invention may allow a clean exterior of a product by preventing exposure of a link structure to the outside while the link structure is used.

A door structure according to one embodiment of the present invention may allow a user to intuitively select an opening direction of a door because pull-down opening is available when a handle is horizontally positioned and side-swing opening is available when the handle is vertically positioned.

Also, according to one embodiment of the present invention, since a locking position exists between a side-swing position and a pull-down position of the handle, it is possible to increase user convenience by allowing a user to rotate the handle along a shortest path to set an opening direction and locking of the door.

Also, according to one embodiment of the present invention, since the handle is temporarily fixed at each of the side-swing position, the pull-down position, and the locking position, unintentional operation of the door due to incorrect operation of the handle may be prevented.

Also, according to one embodiment of the present invention, since each hinge part is not exposed even when the door is opened by being pulled downward or swung sideward, a user's emotional quality may be further increased.

Also, according to one embodiment of the present invention, since the door is moved upward in a closing direction when being opened in a pull-down method, a phenomenon in which the door is too quickly opened may be prevented.

Although the embodiments of the present invention have been described with reference to the drawings, the present invention is not limited to the embodiments and the drawings and it should be obvious to one of ordinary skill in the art that various modifications may be made without departing from the range of the technical concept of the present invention. In addition, although actions and effects of the components of the present invention have not been explicitly disclosed in the above description of the embodiments of the present invention, expectable effects of the corresponding components should also be appreciated.

What is claimed is:

1. A door that includes a double hinge operation structure that is configured to couple to a body and that is configured to rotate relative to the door, the door comprising:

a handle located at a first corner of the door and configured to rotate about a handle shaft, the handle comprising a holding hook and a switch configured to apply elastic force to the holding hook;

a handle base that is coupled to the door and that is configured to support rotation of the handle shaft, the handle base defining a plurality of holding holes arranged about a rotational center of the handle shaft in a circumferential direction of the handle shaft;

a handle link configured to rotate about the handle shaft based on rotation of the handle;

a first swing hinge shaft that is located at a second corner of the door and configured to protrude outward from and retract into a first side of the door that extends from the first corner to the second corner;

a pull-down bar that is located at a third corner of the door and that is configured to protrude outward from and retract into a second side of the door that extends between the first corner and the third corner, the third corner being located at a diagonal position of the second corner;

a first main link having a first end rotatably connected to the handle link, a second end rotatably connected to the first swing hinge shaft, and a first rotation supporting point that is located between the first end and the second end of the first main link and that is configured to rotatably support the first main link, the first main link being configured to rotate about the first rotation supporting point; and a second main link having a first end rotatably connected to the handle link, a second end rotatably connected to the pull-down bar, and a second rotation supporting point that is located between the first end and the second end of the second main link and that is configured to rotatably support the second main link, the second main link being configured to rotate about the second rotation supporting point, wherein the handle is configured to rotate about the handle shaft between a pull-down position and a side-swing position and to rotate to a locked position between the pull-down position and the side-swing position, wherein the pull-down bar is configured to:

protrude outward from the second side of the door based on the handle rotating from the side-swing position to the pull-down position, and retract inward into the second side of the door based on the handle rotating from the pull-down position to the side-swing position, wherein the first swing hinge shaft is configured to:

protrude outward from the first side of the door based on the handle rotating from the pull-down position to the side-swing position, and retract inward into the first side of the door based on the handle rotating from the side-swing position to the pull-down position, wherein the pull-down bar is configured to maintain a state of protruding outward from the second side of the door based on the handle being positioned at the locked position, wherein the first swing hinge shaft is configured to maintain a state of protruding outward from the first side of the door based on the handle being positioned at the locked position, and wherein the holding hook is configured to:

insert into a holding hole of the plurality of holding holes based on the elastic force, and be released from the holding hole based on the switch being pushed to overcome the elastic force applied to the holding hook.

2. The door of claim 1, wherein at least one of the first main link or the handle link defines a first handle-side slit that allows the handle link to translate and rotate relative to the first main link and that is configured to receive a connection part configured to connect the handle link to the first main link.

3. The door of claim 1, further comprising a first intermediate link that is configured to rotatably connect the handle link to the first main link, the first intermediate link having a first end rotatably connected to the handle link and a second end rotatably connected to the first main link.

4. The door of claim 1, wherein the first swing hinge shaft is configured to, based on movement with respect to the first side of the door, be exposed outside of the door or insert into an inside of the door, and wherein at least one of the first swing hinge shaft or the first main link defines a swing hinge side slit that allows the first swing hinge shaft to translate and rotate relative to the first main link and that is configured to receive a connection part configured to connect the first swing hinge shaft to the first main link.

5. The door of claim 1, wherein at least one of the handle link or the second main link defines a second handle-side slit that allows the handle link to translate and rotate relative to the second main link and that is configured to receive a connection part configured to connect the handle link to the second main link.

6. The door of claim 1, further comprising a second intermediate link that is configured to rotatably connect the handle link to the second main link, the second intermediate link having a first end rotatably connected to the handle link and a second end rotatably connected to the second main link.

7. The door of claim 1, wherein the pull-down bar is configured to, based on movement with respect to the second side of the door, be exposed outside of the door or insert into an inside of the door, and wherein at least one of the pull-down bar or the second main link defines a pull-down hinge side slit that allows the pull-down bar to translate and rotate relative to the second main link and that is configured to receive a connection part configured to connect the pull-down bar to the second main link.

8. The door of claim 1, wherein the first main link extends in a first direction toward the first swing hinge shaft, and the second main link extends in a second direction toward the pull-down bar, and wherein at least one of the first main link or the second main link includes a deflected portion that extends in a direction different from the first direction or the second direction.

9. The door of claim 1, wherein the handle comprises a grip portion that extends from the handle shaft, that is configured to be oriented to a horizontal direction of the door toward the second corner based on the handle being oriented to the pull-down position, and that is configured to be oriented to a vertical direction of the door toward the third corner based on the handle being oriented to the side-swing position.

10. The door of claim 1, wherein the holding hook is further configured to, based on the handle being positioned at the pull-down position, the locked position, or the side-swing position, insert into one of the plurality of holding holes to restrict rotation of the handle.

11. A cooking apparatus comprising:

a body that defines a cavity having a front opening;

a door configured to couple to the body and configured to open and close at least a portion of the front opening, the door comprising:

a handle located at a first corner of the door and configured to rotate about a handle shaft, the handle comprising a holding hook and a switch configured to apply elastic force to the holding hook, a handle base that is coupled to the door and that is configured to support rotation of the handle shaft, the handle base defining a plurality of holding holes arranged about a rotational center of the handle shaft in a circumferential direction of the handle shaft, a handle link configured to rotate about the handle shaft based on rotation of the handle, a first swing hinge shaft that is located at a second corner of the door and configured to protrude outward from and retract into a first side of the door that extends from the first corner to the second corner, a pull-down bar that is located at a third corner of the door and that is configured to protrude outward from and retract into a second side of the door that extends between the first corner and the third corner, the third corner being located at a diagonal position of the second corner, a first main link having a first end rotatably connected to the handle link, a second end rotatably connected to the first swing hinge shaft, and a first rotation supporting point that is located between the first end and the second end of the first main link and that is configured to rotatably support the first main link, the first main link being configured to rotate about the first rotation supporting point, and a second main link having a first end rotatably connected to the handle link, a second end rotatably connected to the pull-down bar, and a second rotation supporting point that is located between the first end and the second end of the second main link and that is configured to rotatably support the second main link, the second main link being configured to rotate about the second rotation supporting point;

a hinge guide that is located at the body at a position corresponding to the second corner of the door, that is configured to receive the first swing hinge shaft based on the first swing hinge shaft protruding from the first side of the door, and that is configured to be spaced apart from the first swing hinge shaft based on the first swing hinge shaft retracting into the first side of the door;

a mixed hinge that is located at the body at a position corresponding to a fourth corner of the door, that is located at a diagonal position of the first corner of the door, and that extends along a protrusion-retraction direction of the first swing hinge shaft;

a pull-down hinge located at the body at a position corresponding to the third corner of the door; and a second swing hinge shaft that rotatably couples the mixed hinge to the fourth corner of the door and that extends in the protrusion-retraction direction of the first swing hinge shaft, and wherein the pull-down hinge defines a pull-down bar fastening hole that is configured to receive the pull-down bar based on the pull-down bar protruding from the second side of the door and that is configured to be spaced apart from the pull-down bar based on the pull-down bar retracting into the second side of the door, wherein the handle is configured to rotate about the handle shaft between a pull-down position and a side-swing position and to rotate to a locked position between the pull-down position and the side-swing position, wherein the pull-down bar is configured to maintain a state of protruding outward from the second side of the door based on the handle being positioned at the locked position, wherein the first swing hinge shaft is configured to maintain a state of protruding outward from the first side of the door based on the handle being positioned at the locked position, and wherein the holding hook is configured to:

insert into a holding hole of the plurality of holding holes based on the elastic force, and be released from the holding hole based on the switch being pushed to overcome the elastic force applied to the holding hook.

12. The cooking apparatus of claim 11, wherein the mixed hinge comprises:

a first pull-down body coupled to the body; and a first bracket that is coupled to the first pull-down body by a first pull-down hinge, that is coupled to the fourth corner of the door by the second swing hinge shaft, and that is configured to rotate about the first pull-down hinge based on rotation of the door.

13. The cooking apparatus of claim 12, wherein the door is configured to close the front opening in an upward direction of the body, and wherein the first pull-down body is configured to elastically move in the upward direction.

14. The cooking apparatus of claim 11, wherein the pull-down hinge comprises:

a second pull-down body coupled to the body; and a second bracket that is coupled to the second pull-down body by a second pull-down hinge, that defines the pull-down bar fastening hole, and that is configured to interfere with the third corner of the door based on insertion of the pull-down bar into the pull-down bar fastening hole, wherein the pull-down bar fastening hole is configured to restrict rotation of the second bracket about the pull-down bar based on insertion of the pull-down bar into the pull-down bar fastening hole, and wherein the second bracket is configured to rotate around the second pull-down hinge based on rotation of the door in a state in which the pull-down bar is inserted into the pull-down bar fastening hole.

15. The cooking apparatus of claim 11, wherein the pull-down bar is configured to:

protrude outward from the second side of the door based on the handle rotating from the side-swing position to the pull-down position, and retract inward into the second side of the door based on the handle rotating from the pull-down position to the side-swing position, and wherein the first swing hinge shaft is configured to:

protrude outward from the first side of the door based on the handle rotating from the pull-down position to the side-swing position, and retract inward into the first side of the door based on the handle rotating from the side-swing position to the pull-down position.

16. The cooking apparatus of claim 11, wherein at least one of the first main link or the handle link defines a first handle-side slit that allows the handle link to translate and rotate relative to the first main link and that is configured to receive a connection part configured to connect the handle link to the first main link.

17. The cooking apparatus of claim 11, further comprising a first intermediate link that is configured to rotatably connect the handle link to the first main link, the first intermediate link having a first end rotatably connected to the handle link and a second end rotatably connected to the first main link.

18. The cooking apparatus of claim 11, wherein the first swing hinge shaft is configured to, based on movement with respect to the first side of the door, be exposed outside of the door or insert into an inside of the door, and wherein at least one of the first swing hinge shaft or the first main link defines a swing hinge side slit that allows the first swing hinge shaft to translate and rotate relative to the first main link and that is configured to receive a connection part configured to connect the first swing hinge shaft to the first main link.

19. The cooking apparatus of claim 11, wherein the holding hook is further configured to, based on the handle being positioned at the pull-down position, the locked position, or the side-swing position, insert into one of the plurality of holding holes to restrict rotation of the handle.

* * * * *